US010496031B2

(12) United States Patent
Sugiyama

(10) Patent No.: US 10,496,031 B2
(45) Date of Patent: Dec. 3, 2019

(54) IMAGE FORMING APPARATUS PROVIDED WITH A SHEET PROCESSING DEVICE

(71) Applicant: Akira Sugiyama, Yamanashi-ken (JP)

(72) Inventor: Akira Sugiyama, Yamanashi-ken (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 0 days.

(21) Appl. No.: 16/266,623

(22) Filed: Feb. 4, 2019

(65) Prior Publication Data

US 2019/0250552 A1 Aug. 15, 2019

(30) Foreign Application Priority Data

Feb. 9, 2018 (JP) ..... 2018-021828

(51) Int. Cl.
*G03G 21/16* (2006.01)
*G03G 15/00* (2006.01)
*B65H 31/10* (2006.01)

(52) U.S. Cl.
CPC ..... *G03G 21/1638* (2013.01); *B65H 31/10* (2013.01); *G03G 15/6541* (2013.01); *G03G 15/6573* (2013.01); *G03G 2215/00827* (2013.01); *G03G 2221/1675* (2013.01)

(58) Field of Classification Search
CPC ..... G03G 21/1638; G03G 15/6573; G03G 15/6541; G03G 2215/00827; G03G 2221/1675; B65H 31/10
See application file for complete search history.

(56) References Cited

FOREIGN PATENT DOCUMENTS

| | | | |
|---|---|---|---|
| JP | 2010262075 A | * | 11/2010 |
| JP | 2014-106294 A | | 6/2014 |
| JP | 2017-009729 A | | 1/2017 |
| JP | 2017-081727 A | | 5/2017 |

* cited by examiner

*Primary Examiner* — Susan S Lee
(74) *Attorney, Agent, or Firm* — Manabu Kanesaka

(57) ABSTRACT

To allow easy access to a jammed sheet when a sheet jam occurs in a sheet processing device installed inside the body of an image forming apparatus. An image forming apparatus is provided with a sheet binding unit that applies binding to sheets. The sheet binding unit has a carry-in port for receiving a sheet to be conveyed to a sheet carry-in path formed thereinside and an openable cover for opening the carry-in port. The end portion of the openable cover on the carry-in port side and an end portion of an operation part for inputting an operational item for the operation carried out in the image forming apparatus are arranged spaced apart from each other at a predetermined distance.

7 Claims, 9 Drawing Sheets

FIG. 4A Paddle elevated position Sheet discharge
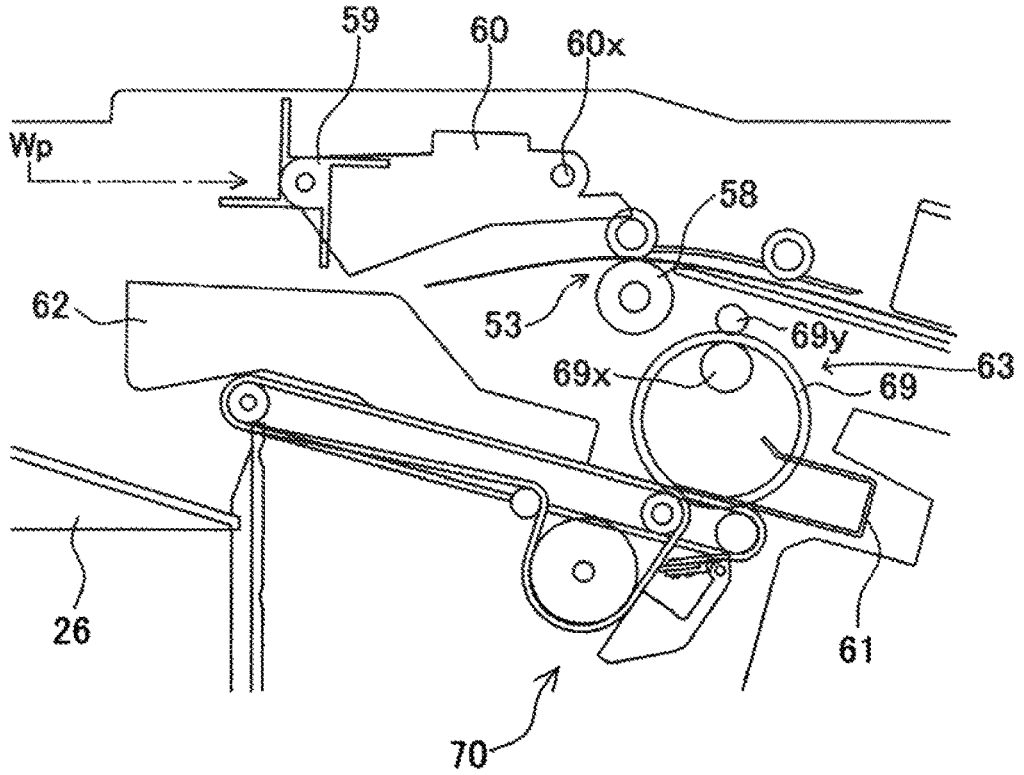
FIG. 4B Paddle lowered position
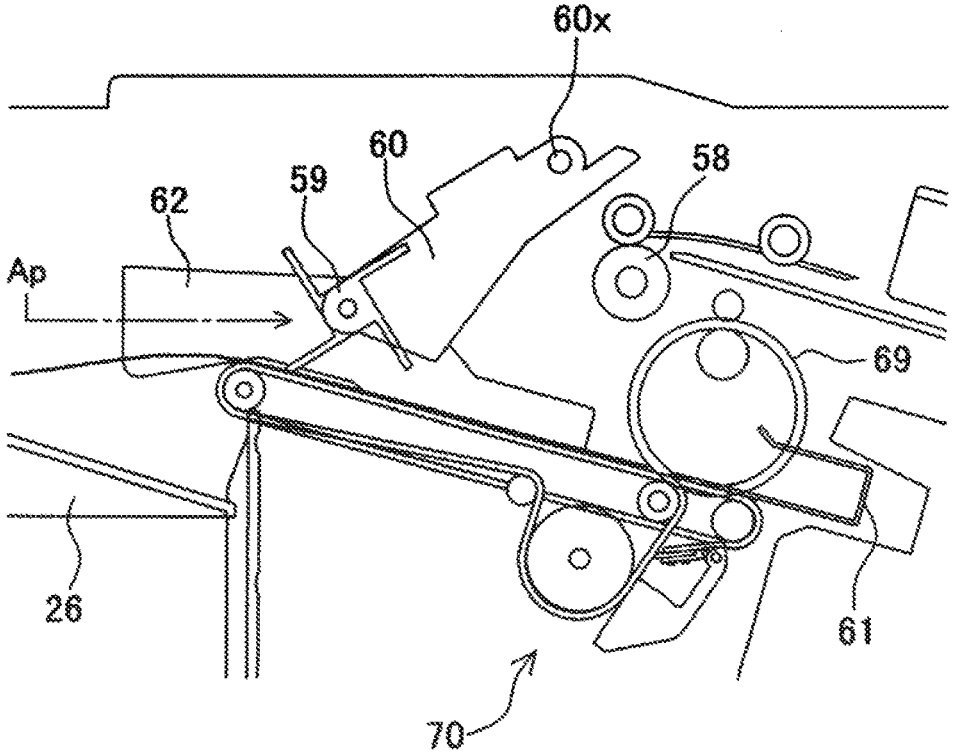

IMAGE FORMING APPARATUS PROVIDED WITH A SHEET PROCESSING DEVICE

BACKGROUND OF THE INVENTION

Field of the Invention

The present invention relates to an image forming apparatus such as a copier, a printer, a facsimile, or a digital multifunction machine having combined functions thereof provided with a sheet processing device that applies predetermined processing to image-formed sheets.

Description of the Related Art

There is known a sheet processing device which is provided in an image forming system having an image forming apparatus for forming an image on a sheet as a core component and which applies, to sheets discharged from the image forming apparatus, processing such as punching, binding, aligning, sorting, and the like. The sheet processing device that performs such processing includes a so-called side-face installation type and an in-body installation type. The side-face installation type sheet processing device is provided independently of the image forming apparatus and disposed beside the main body of the image forming apparatus so as to receive sheets discharged from the side surface of the image forming apparatus main body. The in-body installation type sheet processing device is disposed in an in-body space provided in the installation area of the image forming apparatus main body.

The side-face installation type sheet processing device is connected to the outer cover side of the image forming apparatus main body to constitute an image forming system, so that a large installation space is required for the overall system. On the other hand, the in-body installation type sheet processing device is housed within the installation area of the image forming apparatus main body, so that the installation space can significantly be saved as compared to the side-face installation type sheet processing device.

As an image forming system including the in-body installation type sheet processing device, Patent Document 1 discloses a system having a space provided at the upper portion of an image forming part, above which a document reading part of an image forming apparatus is disposed and within which a sheet processing device provided with a sheet binding part for binding sheets and a sheet stacking part for stacking sheets thereon is disposed. The sheet processing device disposed within the space is configured to apply post-processing such as punching or binding to sheets discharged by a sheet discharge roller provided in the image forming part of the image forming apparatus and to accommodate the processed sheets on the sheet stacking part.

Further, as illustrated in FIG. 4 of Patent Document 1, the sheet processing device is disposed inside the body of the image forming apparatus main body through a slidable mechanism. The slidable mechanism allows easy connection and separation between the image forming apparatus and the sheet processing device. When a sheet conveyance failure such as a sheet jam occurs between the image forming apparatus and the sheet processing device, the sheet processing device is slid to be separated from the image forming apparatus, and the jammed sheet is removed.

The stacking amount of the sheet stacking part of such an in-body installation type sheet processing device is generally about 500 sheets at maximum since the movable range of a sheet stacking tray for stacking thereon discharged sheets is limited to the vertical range in the in-body space. However, there is a great need to increase the stacking amount to about 1000 to 2000 sheets. Patent Document 2 discloses a configuration in which the sheet stacking part is disposed outside the in-body space of the image forming apparatus so as to increase the sheet stacking amount without involving significant increase in the installation area of the image forming system. More specifically, a guide part for guiding elevating/lowering of a stacking tray of the sheet stacking part is provided along the side surface of the image forming apparatus main body. This allows the stacking tray to be moved in a range equal to or larger than the width of the in-body space, thereby increasing the sheet stacking amount.

Further, Patent Document 1 discloses an image forming apparatus having a sheet processing device disposed in an in-body space between a reading part and an image forming part (see FIG. 6). The image forming apparatus is provided with operation information part (hereinafter, referred to an operation panel) so as to allow various processing functions that can be executed in the image forming apparatus to be displayed or to be input by a user. In recent years, with increase in the amount of information required to be displayed, the size of the operation panel is increased for the purpose of improving visibility and operability. Further, aiming to make users easily handle the operation panel regardless of their age, gender, or body-build, or regardless of presence/absence of physical disabilities, such a design is adopted that operation panel is provided so as to protrude to the operator side.

PRIOR ART DOCUMENT

Patent Document

[Patent Document 1] Japanese Patent Application Publication No. 2014-106294
[Patent Document 2] Japanese Patent Application Publication No. 2017-081727
[Patent Document 3] Japanese Patent Application Publication No. 2017-009729

The sheet processing devices disclosed in Patent Document 1 and Patent Document 3 are each disposed in the in-body space between the reading part and the image forming part, including the sheet stacking part for stacking thereon processed sheets. This limits the elevating/lowering range of a sheet stacking tray (sheet discharge tray) provided in the sheet stacking part to a range vertically sandwiched between the reading part and the image forming part. Although the sheet stacking amount can be increased by the disposition of the stacking tray as disclosed in Patent Document 2, the weight significantly increases when sheets are fully stacked on the stacking tray.

In order for the sheet processing device to be slid using the slide mechanism disclosed in Patent Document 1 so as to remove a sheet jammed in the device with the sheet stacking tray on which the sheets are fully stacked being supported by the slide mechanism, it is necessary to increase rigidity around the slide mechanism, which may result in a significant increase in cost as compared to conventional in-body installation type sheet processing devices. Further, a complicate configuration is required for controlling the gravity balance of the entire image forming apparatus when the sheet processing device with the sheets fully stacked on the stacking tray is slid outward from the in-body space, which may result in an increase in the device size. Further, when a sheet jam occurs inside the sheet processing device, the large-sized operation panel may interfere with access to the device inside, hindering the sheet removal operation.

SUMMARY OF THE INVENTION

The present invention has been made in view of the above problems, and the object thereof is to provide an image forming apparatus in which, when removing a sheet jammed in a sheet processing device having a sheet processing part that performs post-processing for sheets disposed in an in-body space provided in the installation area of the main body of the image forming apparatus, access to the jammed sheet can be easily made.

To solve the above problems, the present invention adopts the following configuration.

There is provided an image forming apparatus including: an image reading part for reading an image; an image forming part disposed below the image reading part with a space part provided below the image reading part interposed therebetween and configured to form an image on a sheet; a sheet processing device including a sheet processing part provided inside the space part between the image reading part and the image forming part and configured to apply binding to sheets and a first stacking part disposed adjacent to the sheet processing part and outside the space part and configured to stack thereon the sheets processed by the sheet processing part; a first discharge part for discharging the sheet on which an image is formed by the image forming part toward the sheet processing part; a second discharge part for discharging the sheet on which an image is formed by the image forming part toward the space part; and an operation part inputting a predetermined operational item to the image reading part, image forming part, and sheet processing device. The sheet processing device includes a carry-in part for receiving a sheet from the first discharge part; a conveyance unit for conveying the sheet received from the carry-in part toward the sheet processing part in a predetermined conveyance direction; an openable cover disposed above the conveyance unit and configured to open the carry-in part for removal of a sheet when a sheet conveyance failure occurs in the conveyance unit; and a second stacking part for stacking a sheet discharged from the second discharge part on an upper surface of the openable cover; and the carry-in part is disposed on a downstream side in the conveyance direction so as to be spaced apart at a predetermined distance from an end portion of the operation part on the downstream side in the conveyance direction.

With the above configuration, it is possible to easily access a jammed sheet in the sheet processing device and remove the jammed sheet.

BRIEF DESCRIPTION OF THE DRAWINGS

FIGS. 4A and 4B are explanatory views of a sheet carry-in mechanism in the device of FIG. 2, in which FIG. 4A illustrates a state where a paddle rotating body is at a waiting position, and FIG. 4B illustrates a state where the paddle rotating body is at an engagement position;

FIGS. 7A to 7D are explanatory views of a sheet bundle carry-out unit in the device of FIG. 2, in which FIG. 7A illustrates a waiting state, FIG. 7B illustrates a relay state, FIG. 7C illustrates the structure of a second bundle conveyance member; and FIG. 7D illustrates a state where a sheet bundle is discharged onto a first stack tray;

DETAILED DESCRIPTION OF THE INVENTION

Figure 1:
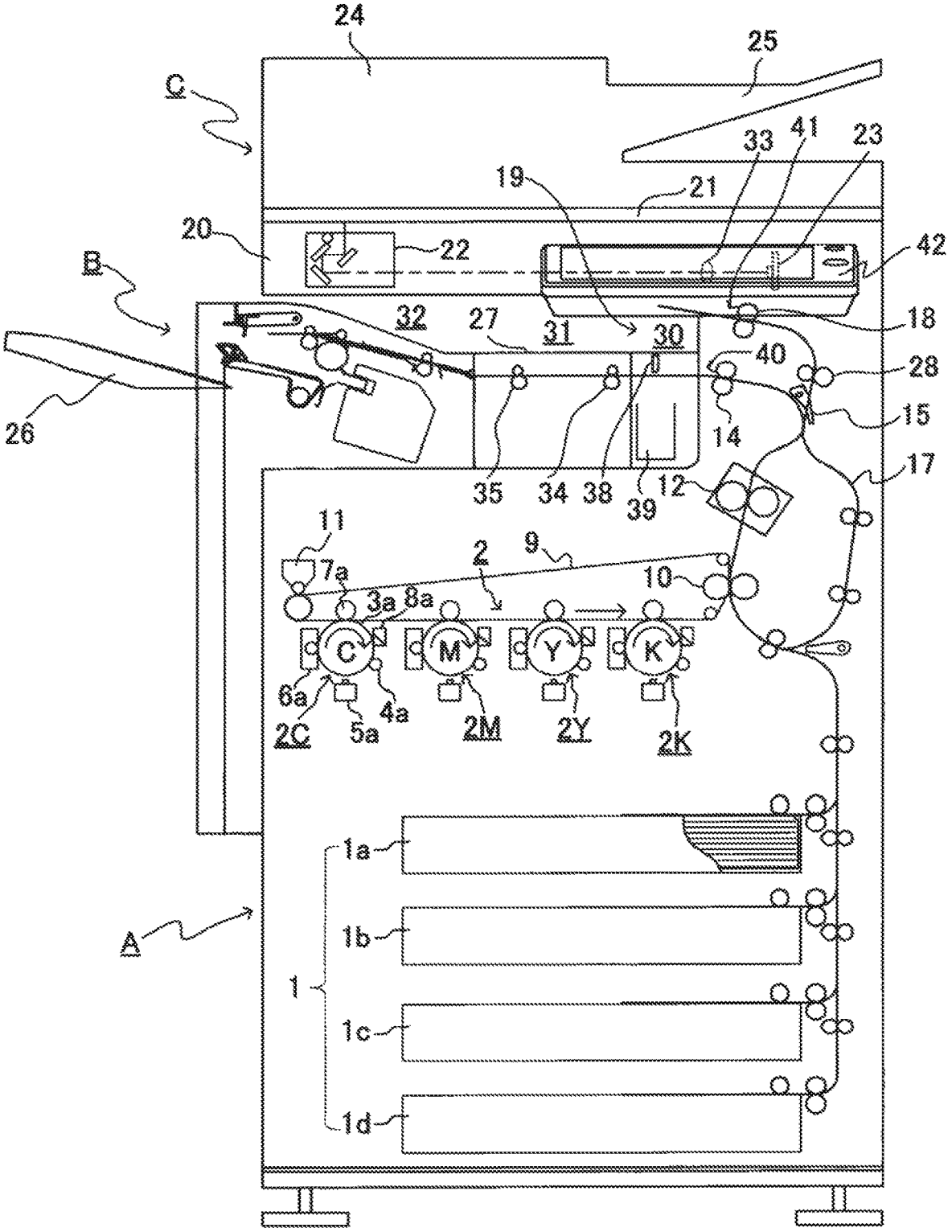
FIG. 1 is an explanatory view illustrating the entire configuration of an image forming apparatus provided with a sheet binding device according to the present invention.

Hereinafter, a sheet post-processing unit B as a discharge unit according to the present invention and an image forming unit A to which the sheet post-processing unit B is attached will be described with reference to the drawings. FIG. 1 is an explanatory view illustrating the entire configuration of an image forming apparatus combining the image forming unit A, sheet post-processing unit B, and an image reading unit C. The image reading unit C reads an image on a document or the like as image data, and the image forming unit A forms an image on a sheet based on the image data. Then, in the sheet post-processing unit B, the image-formed sheets are punched, stacked in an aligned manner, bound, and stacked on a first stack tray (first stacking part) positioned on the downstream side in a sheet conveyance direction. On the other hand, sheets that are not subjected to processing in the sheet post-processing unit B are stacked on a second stack tray (second stacking part, third stacking part, fourth stacking part) positioned above the sheet post-processing unit B.

The sheet post-processing unit B to be described later is incorporated as one unit in a sheet discharge space 19 formed in the housing of the image forming unit A and includes a punch unit 30, a relay conveyance unit 31, and a sheet binding unit 32. The punch unit 30 applies punching to image-formed sheets conveyed to a first discharge port 40 (first discharge part). The relay conveyance unit 31 relays the sheets between units. The sheet binding unit 32 accumulates the sheets on a processing tray in an aligned state, applies binding thereto, and stacks the bound sheets on the first stack tray disposed on the downstream side in the sheet conveyance direction. Further, although not illustrated, a configuration may be adopted, in which the punch unit 30 and the relay conveyance unit 31 are omitted. In this case, the sheet binding unit 32 may directly receive sheets conveyed from the first discharge port 40.

Further, there is provided an operation part 42 for an operator of the image forming apparatus to select: a reading mode (one-side reading, double-side reading, color reading, monochrome reading, etc.) for the image reading unit C; an image formation mode (one-side printing, double-side printing, etc.) and a sheet size for the image forming unit A; and a processing mode (punching, binding, etc.) for the sheet post-processing unit B, and to check information and a status.

An apparatus front side Fr in the description of the apparatus according to the present invention refers to the apparatus front side at which an operator of the apparatus performs various operations. In an ordinary image forming apparatus, there is provided, on the apparatus front side Fr, an operation part 42 (operation panel) for the operator to input processing information, to check the status of the apparatus, and the like, a cover (opening/closing cover) for a sheet cassette of the image forming apparatus, or an opening/closing cover for replenishment of staples of a stapler unit. An apparatus rear side Re refers to the side of the apparatus that faces the wall of a building or the like in an installation state of the apparatus (when the design condition specifies that the apparatus rear side faces a wall). Further, when the apparatus is viewed from the front side, a sheet movement direction from the right to left is defined as a sheet discharge direction.

[Image Forming Unit]

The image forming unit A illustrated in FIG. 1 is of an electrophotographic type. A sheet feed part 1 including four sheet cassettes 1*a*, 1*b*, 1*c*, and 1*d* for storing sheets is provided below an image forming part 2. The sheet post-processing unit B is disposed above the image forming part 2, and the image reading unit C is disposed above the sheet post-processing unit B. Thus, the sheet post-processing unit B is of an in-body installation type. That is, the sheet post-processing unit B is disposed in a space between the image reading unit C and the image forming part 2. When the sheet post-processing unit B is not attached to the image forming unit A, the sheet discharge space 19 between the image forming part 2 and the image reading unit C can be used as a sheet stacking part for stacking sheets discharged from the image forming part 2.

The above image forming part 2 adopts a tandem system using an intermediate transfer belt. That is, four color components (cyan 2C, magenta 2M, yellow 2Y, black 2K) are used. For example, for the cyan 2C, the image forming part 2 has a photoreceptor drum 3*a* as an image carrier, a charger 4*a* including a charging roller that charges the photoreceptor drum 3*a*, and an exposing device 5*a* that forms a latent image from an image signal read by the image reading unit C.

The image forming part 2 further has a developing device 6*a* that forms a toner image from the latent image formed on the photoreceptor drum 3*a* and a primary transfer roller 7*a* that primary-transfers the image on the photoreceptor drum 3*a* formed by the developing device 6*a* onto an intermediate transfer belt 9. The above configuration is provided for each color component, and images of all four colors are primary-transferred onto the intermediate transfer belt 9. Residual color components on the photoreceptor drum 3*a* are collected by a photoreceptor cleaner 8*a* for the subsequent image formation. Although the configuration for the cyan 2C has been described mainly, the same configuration may be applied to the other color components as illustrated in FIG. 1.

A toner image transferred onto the intermediate transfer belt 9 by the primary transfer rollers provided for respective color components is then transferred, by a secondary transfer roller 10, onto a sheet fed from the sheet feed part 1 and melted by pressurization and heating by a fixing device 12 so as to be fixed thereonto. Residual four overlapped color components on the intermediate transfer belt 9 are removed by an intermediate belt cleaner 11 for the subsequent transfer.

The thus image-formed sheet is fed to the sheet post-processing unit B from the first discharge port 40 by a first main body discharge roller 14. When an image is formed on both sides of the sheet, the front end of the sheet in the sheet conveyance direction is directed to a second discharge port 41 by a switching gate 15. Thereafter, the sheet is conveyed by a conveyance roller 28 and a second main body discharge roller 18 until the rear end of the sheet is detected by a not-shown sensor. When the rear end of the sheet is detected, the sheet conveyance is stopped, and the sheet conveyed toward the second discharge port 41 is switched back to be conveyed to a circulation path 17 and then conveyed once again to the secondary transfer roller 10 at which an image is formed on the back side of the sheet.

A discharge port through which the image-formed sheet is discharged from the image forming unit A is selected based on subsequent processing or sheet size. When the sheet is subjected to punching or binding, the sheet is discharged toward the sheet post-processing unit B through the first discharge port 40 and subjected to punching by the punch unit 30 according to the selection. Then, the sheet is conveyed to the sheet binding unit 32 through the relay conveyance unit 31 and subjected to binding according to the selection. After the selected processing, the sheet is stacked on the first stack tray. On the other hand, when a long sheet (e.g., longer size than A3 sheet having a longitudinal side of 420 mm) that is not storable in the first stack tray is selected and an image is formed thereon, the sheet is discharged from the second discharge port 41 (second discharge part) and stacked on the second stack tray provided above the sheet post-processing unit B.

[Image Reading Unit]

The image reading unit C includes an image reading device 20 and a document automatic feeder 24. The image reading device 20 includes a platen 21 and a reading carriage 22 reciprocating along the platen 21. The platen 21 is made of transparent glass. An image reading mode of the image reading unit C includes a stationary image reading mode and a traveling image reading mode. In the stationary image reading mode, a document to be read is placed on the upper surface of the platen 21, and the carriage 22 is moved for image reading; while in the traveling image reading mode, a document to be read is conveyed at a predetermined conveyance speed by the document automatic feeder 24, and the carriage 22 is stopped at a predetermined position for image reading.

The reading carriage 22 includes a light source lamp and a reflecting mirror that polarizes reflected light from a document. The reflected light from the document polarized by the reflecting mirror is emitted, through a condenser lens, to a photoelectric conversion element mounted on a CCD substrate 23. The photoelectric conversion element is constituted by line sensors arranged in the document width direction (main scanning direction) on the platen 21. The reading carriage 22 reciprocates in a sub-scanning direction perpendicular thereto so that a document image is read in line order. Further, the document automatic feeder 24 that feeds a document at a predetermined speed is arranged above the image reading device 20. The document automatic feeder 24 is constituted by a feeder mechanism to feed document sheets set on a document stacker 25 to the platen 21 one by one and to store each document sheet in a sheet discharging tray after each image is read from the document sheet.

[Punch Unit]

The punch unit 30 includes a punching unit 38 for punching the sheet discharged from the first discharge port 40 and passing through a sheet conveyance path in the punch unit 30. The first main body discharge roller 14 for sheet conveyance is disposed on the upstream side of the punching unit 38 in the sheet conveyance direction and is connected to a not-shown drive motor. A not-shown controller (CPU, etc.) is connected to a motor driver that supplies a drive signal to the drive motor. When the controller receives a command instructing it to perform punching from an operation part to be described later that receives a user's operation, it temporarily stops the sheet at the punching position.

The punching unit 38 includes a not-shown punch mechanism 38*a* that punches a punch hole in a sheet passing through the sheet conveyance path in the punch unit 30 and a punch waste box 39 that stores punching chips of the sheet punched by the punch mechanism 38*a*.

The configuration of the punch mechanism 38*a* will be described below. The punch mechanism 38*a* is a general mechanism obtained by combining a rotating eccentric cam and a punch blade, and thus illustration thereof is omitted. A punch member having the punch blade (punch) and a die member having a blade receiving hole are disposed opposite to each other through the sheet conveyance path in the punch unit 30. The punch member is bearing-supported to a unit frame so as to be vertically movable at a predetermined stroke and is connected with a vertically moving punch drive unit.

The punch drive unit includes a drive motor and a drive cam connected thereto. The drive cam is an eccentric cam and is linked to the punch member. The drive motor driver of the punch drive unit is connected to a not-shown controller and is controlled thereby. The punch mechanism 38*a* adopts a shift mechanism that reciprocatively moves one or a plurality of punch members at a predetermined stroke from the top dead center to the bottom dead center, and the shift mechanism is constituted of a drive cam and a drive motor. Alternatively, the punch mechanism may adopt a mechanism (rotary punch mechanism). In this mechanism, projecting punch members integrally formed around a rotating body punch a file hole in a sheet passing therethrough while being rotated.

[Relay Conveyance Unit]

The sheet that has passed through the sheet conveyance path in the punch unit 30 passes through the sheet conveyance path in the relay conveyance unit 31 to be conveyed to the sheet binding unit 32. The sheet conveyance path in the relay conveyance unit 31 is provided with a first relay conveyance roller pair 34 and a second relay conveyance roller pair 35. The first relay conveyance roller pair 34 and the second relay conveyance roller pair 35 are arranged spaced apart from each other at substantially horizontal positions. The distance between the first relay conveyance roller pair 34 and the second relay conveyance roller pair 35 is set substantially equal to the distance between the first main body discharge roller 14 and the first relay conveyance roller pair 34 and to the distance between the second relay conveyance roller pair 35 and a carry-in roller pair 51 provided in the sheet binding unit 32 to be described later and smaller than the minimum sheet length in the sheet conveyance direction of various sheets used in the image forming unit A.

[Sheet Binding Unit]

Figure 2:
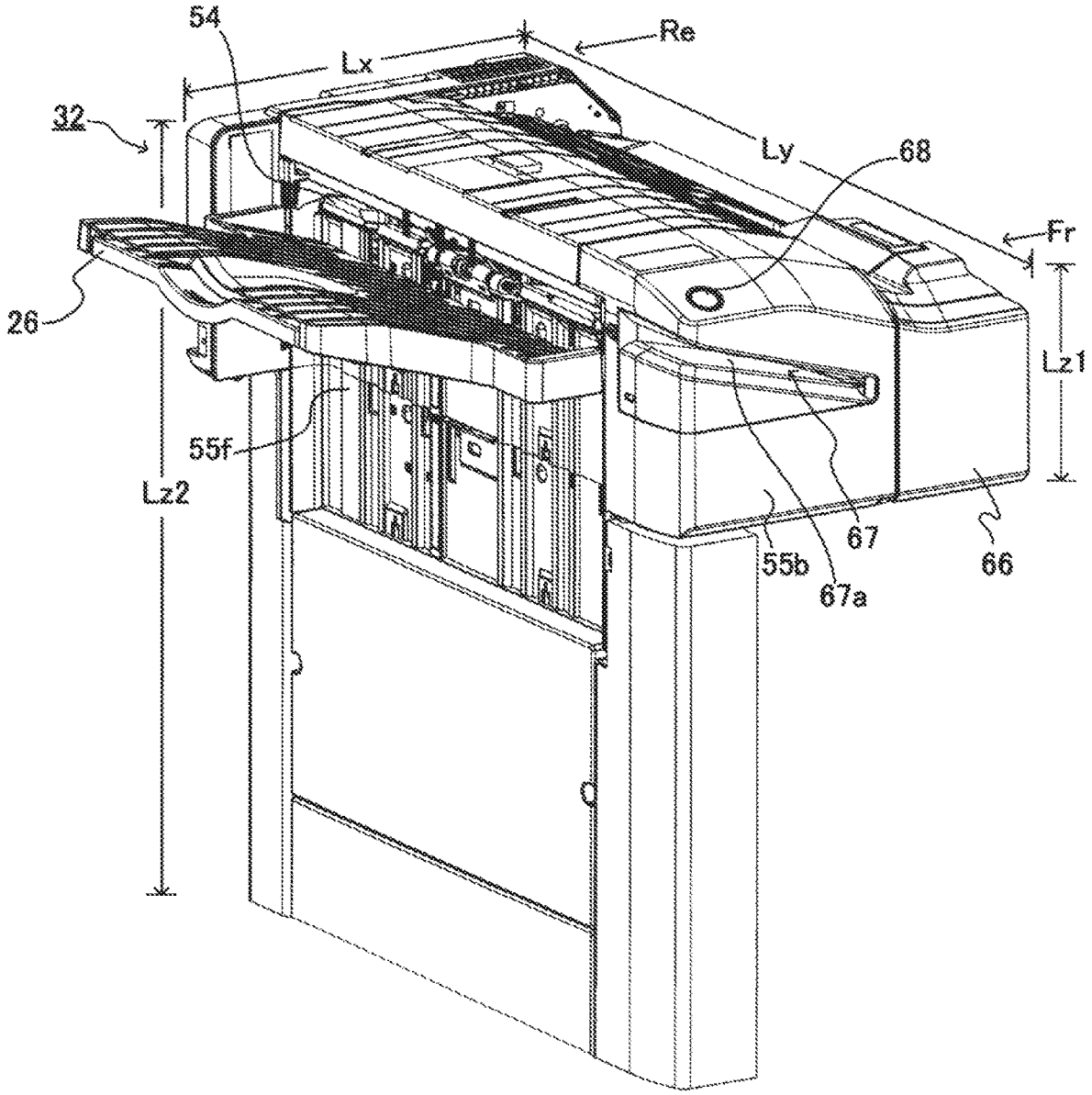
FIG. 2 is a perspective view illustrating the entire configuration of a sheet processing device illustrated in FIG. 1.
Figure 3:
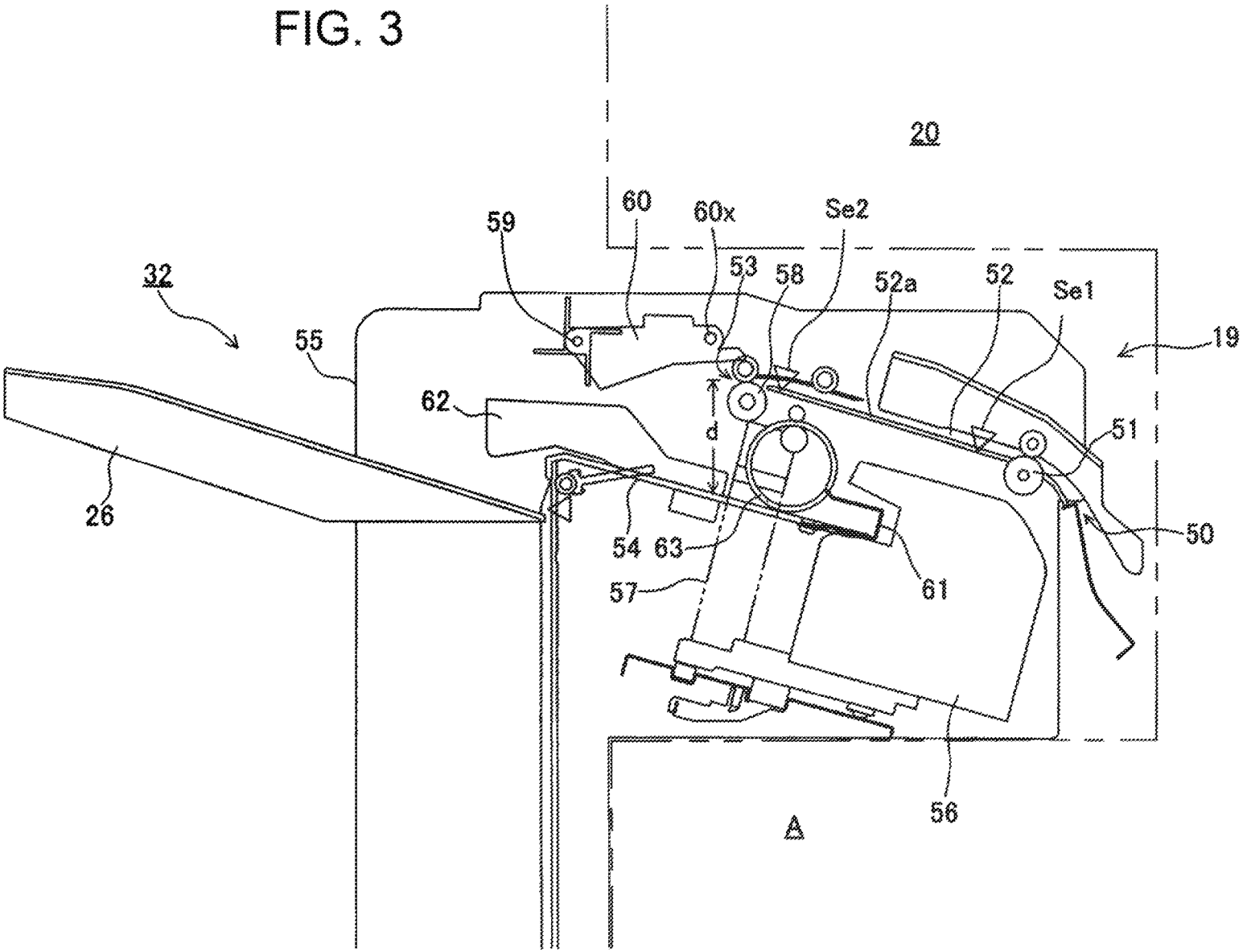
FIG. 3 is a cross-sectional side view (device front side) of the device of FIG. 2.

As illustrated in FIG. 2 which is a perspective of the entire sheet processing device and FIG. 3 which is a cross-sectional view thereof, the sheet binding unit 32 includes a unit housing 55, a sheet carry-in path 52 disposed in the housing 55, a processing tray 54 disposed on the downstream side of the sheet carry-in path 52 in the sheet conveyance direction, and a first stack tray 26 disposed on the downstream side of the processing tray 54 in the sheet conveyance direction.

The processing tray 54 is provided with a sheet carry-in unit 65 for carrying-in sheets, a sheet end regulating unit 61 for accumulating the carried-in sheets in a bundle, and a sheet aligning unit 62 for aligning the sheets accumulated in a bundle by tapping them from a direction perpendicular to the sheet conveyance direction. The processing tray 54 is further provided with a staple binding unit 56 (first binding unit) for binding an aligned sheet bundle with a staple and a stapleless binding unit 57 (second binding unit) for binding an aligned sheet bundle without a staple.

The unit housing 55 is constituted of a unit frame 55*a* and an outer casing 55*b*. The unit frame 55*a* has a frame structure that supports mechanism parts (a path mechanism, a tray mechanism, a conveyance mechanism, etc.). The unit shown has a monocoque structure in which a binding mechanism, a conveying mechanism, a tray mechanism, and a drive mechanism are disposed between a pair of opposing side frames (not shown) and are integrated with the outer casing 55*b*. The outer casing 55*b* is formed in a monocoque structure in which a pair of side frames 55*c* and 55*d* and a stay frame connecting the side frames are integrated by, e.g., resin molding, and a part (unit front side) thereof is exposed so as to be operable from outside.

The sheet binding unit 32 has the above configuration, that is, the outer periphery of the frame thereof is covered with the outer casing 55*b*, and only a sheet binding mechanism part is incorporated in the sheet discharge space 19 of the image forming unit A (that is, the first stack tray 26, a guide part arranged around the first stack tray 26, and a drive part are exposed therefrom). In this state, a part of the outer casing 55*b* on the apparatus front side Fr is exposed so as to be operable from outside. The outer casing 55*b* is provided with, on its apparatus front side Fr, a staple exchange cover 66, a manual feed setting part (insertion part), and a manual operation button 68 (the one shown is a switch incorporating a display lamp) which are to be described later.

A length Lx of the outer casing 55*b* in the sheet conveyance direction and a length Ly thereof in a direction perpendicular to the sheet conveyance direction are set based on the maximum size of a sheet that can be handled by the sheet binding unit 32 and are set smaller than the lengths of the sheet discharge space 19 of the image forming unit A in those directions. Further, a length Lz in the vertical direction (gravity direction) of the outer casing 55*b* in an installation state is set such that a length Lz1 of a portion where a processing part including the staple binding unit 56, stapleless binding unit 57, and the like is set smaller than the vertical length of the sheet discharge space 19 of the image forming unit A and that a length Lz2 of a portion where the first stack tray 26, the guide part disposed around the first stack tray 26, and the drive part are arranged is set so as to correspond to the sheet stacking amount of the first stack tray 26, i.e., the moving amount of the first stack tray 26 determined by the maximum sheet stacking amount.

[Sheet Conveyance Path]

As illustrated in FIG. 3, the unit housing 55 is provided with the sheet carry-in path 52 having a carry-in port 50. The illustrated sheet carry-in path 52 horizontally receives a sheet from the relay conveyance unit 31, conveys the sheet substantially horizontally (in a direction slightly inclined upward in the sheet conveyance direction), and carries out the sheet from a sheet discharge port 53. The sheet carry-in path 52 is formed of an appropriate paper guide (plate) 52*a* and incorporates a conveyance mechanism for sheet conveyance. The conveyance mechanism is constituted by conveyance roller pairs arranged at a predetermined interval according to the path length. Specifically, as illustrated, a carry-in roller pair 51 is provided in the vicinity of the carry-in port 50, and a discharge roller pair 58 is provided in the vicinity of the sheet discharge port 53. The sheet carry-in path 52 is further provided with sheet sensors Sel and Set for detecting the front end and/or rear end of the sheet.

The above sheet carry-in path 52 is constituted by a substantially horizontally extending linear path that crosses the unit housing 55. This is because a curved path may apply unnecessary stress on a sheet to be conveyed, and the path is made linear as much as possible within an allowable range of unit layout. The above carry-in roller pair 51 and discharge roller pair 58 are both connected to a not-shown drive motor M1 (hereinafter, referred to as "conveyance motor") and convey a sheet at the same peripheral speed.

[Processing Tray]

Referring back to FIG. 3, the processing tray 54 is disposed at the sheet discharge port 53 of the sheet carry-in path 52 with a level difference d formed on the downstream side of the sheet discharge port 53 in the sheet conveyance direction. The processing tray 54 is provided with a sheet placing surface 54*a* that supports at least a part of a sheet so as to vertically accumulate sheets fed from the sheet discharge port 53 in a bundle. In the illustrated configuration, a structure (bridge support structure) is adopted, in which the sheet front end side is supported by the first stack tray 26 to be described later, and the sheet rear end side is supported by the processing tray 54. This reduces the size of the tray.

The above processing tray 54 accumulates sheets fed from the sheet discharge port 53 in a bundle, binds the accumulated sheet after aligning the sheets to a predetermined posture, and carries out the bound sheet bundle to the first stack tray 26 on the downstream side in the sheet conveyance direction. To this end, the processing tray 54 incorporates therein a "sheet carry-in unit 65", a "sheet aligning unit 62", a "staple binding unit 56", a "stapleless binding unit 57", and a "sheet bundle carry-out unit 70".

[Sheet Carry-in Unit]

The processing tray 54 is disposed at the sheet discharge port 53 with the level difference d formed therebetween. In order for the sheets to be smoothly conveyed onto the processing tray 54 in a proper posture, the sheet carry-in unit 65 is required. The illustrated sheet carry-in unit 65 (friction rotating body) is constituted by an elevation paddle rotating body 59. At the stage when the rear end of a sheet is carried out from the sheet discharge port 53 onto the tray, the paddle rotating body 59 is rotated to convey the sheet in a direction (direction from the left to right in FIG. 3) opposite to the sheet discharge direction to make the sheet abut against the sheet end regulating unit 61 to be described later for alignment (positioning).

To this end, the sheet discharge port 53 is provided with an elevation arm 60 axially supported to the unit frame 55*a* at a support shaft 60*x* so as to be swingable, and the paddle rotating body 59 is rotatably axially supported to the leading end of the elevation arm 60. The support shaft 60*x* has a not-shown pulley which is connected with the above-mentioned conveyance motor M1.

Further, the elevation arm 60 is connected with an elevation motor M3 (hereinafter, referred to as "paddle elevation motor") through a spring clutch (torque limiter) and is elevated/lowered between an upper waiting position Wp and a lower actuation position (engagement position with a sheet) Ap by rotation of the paddle elevation motor M3. That is, the spring clutch elevates the elevation arm 60 from the actuation position Ap to the waiting position Wp by one direction rotation of the paddle elevation motor M3, and the elevation arm 60 waits at the waiting position Wp after abutting against a not-shown locking stopper. On the other hand, the spring clutch is relaxed by the opposite-direction rotation of the paddle elevation motor M3, causing the elevation arm 60 to be lowered by its own weight from the waiting position Wp to the lower actuation position Ap and then to be engaged with the uppermost sheet of the sheets accumulated on the processing tray 54.

Figure 5:
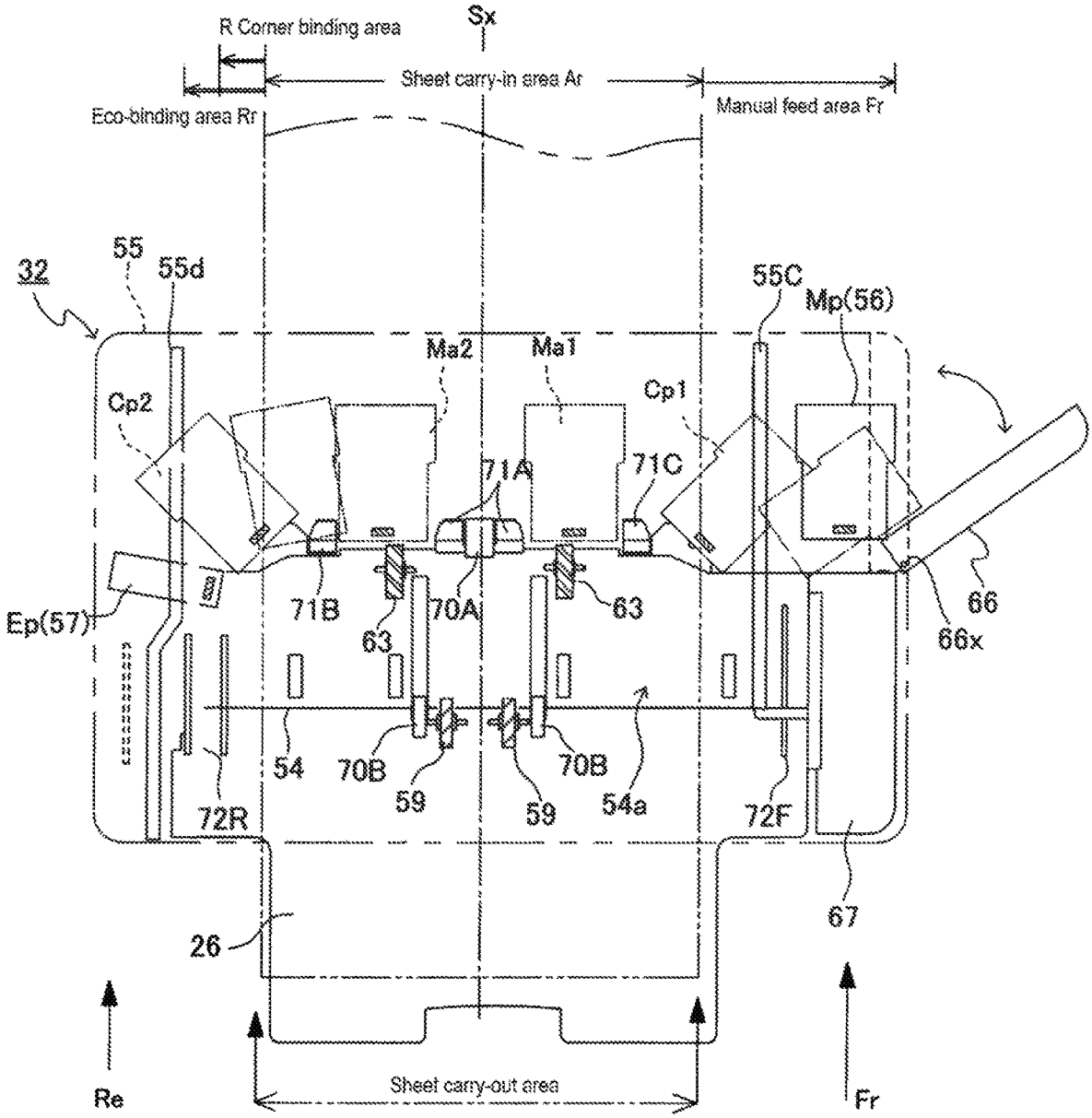
FIG. 5 is an explanatory view illustrating the arrangement relationship between areas and an aligning position in the device of FIG. 2.

In the example of FIG. 5, a pair of paddle rotating bodies 59 are disposed symmetrically with respect to a sheet center (center reference Sx) and spaced apart from each other at a predetermined distance. Alternatively, three paddle rotating bodies may be disposed at the sheet center and both sides thereof, or only one paddle rotating body may be disposed at the sheet center.

The above paddle rotating body 59 is constituted by a flexible rotating body such as a rubber-like plate member or a plastic blade member. In addition to the paddle rotating member, a rotating member, such as a roller body or a belt body, whose surface has adequate friction may be used to constitute the sheet carry-in unit 65. Further, in the above example, the paddle rotating body 59 is lowered from the upper waiting position Wp to the lower actuation position Ap after the sheet rear end is carried out from the sheet discharge port 53; however, the following elevation control may be adopted.

For example, at the stage when the sheet front end is carried out from the sheet discharge port 53, a friction rotating body is lowered from the waiting position to the actuation position and, at the same time, the friction rotating body is rotated in the sheet carry-out direction and, then, at the timing when the sheet rear end is carried out from the sheet discharge port 53, the friction rotating body is rotated in the direction opposite to the sheet carry-out direction. With this configuration, it is possible to convey the sheet carried out from the sheet discharge port 53 to a predetermined position on the processing tray 54 at high speed and without skew.

When a sheet is conveyed to a predetermined position on the processing tray 54 by the sheet carry-in unit 65 (paddle rotating body) disposed at the sheet discharge port 53, a raking conveyance unit 63 is required to reliably guide the front end of the sheet (in particular, the front end of a curled or skewed sheet) to the sheet end regulating unit 61.

In the illustrated example, a raking rotating body (raking conveyance unit) 63 that conveys the uppermost sheet of sheets stacked on the upstream side of the sheet end regulating unit 61 to be described later toward the sheet end regulating unit 61 side is disposed below the discharge roller pair 58. The raking rotating body 63 includes a ring-shaped belt member 69 (hereinafter, referred to as "raking belt") which is disposed at a position opposite to the sheet carry-in unit 65 with respect to the discharge roller pair 58 of the processing tray 54. The raking belt 69 is engaged with the uppermost sheet of the sheets stacked on the processing tray 54 and rotates in such a direction as to convey the sheet to the sheet end regulating unit 61 side.

The raking belt 69 is constituted by a high-friction belt member (knurling belt) formed of a flexible material such as rubber and is supported so as to be held between a rotary shaft 69*x* connected to a drive motor (the one shown is the conveyance motor M1) and an idle shaft 69*y*. The raking belt 69 is imparted with a torque in the counterclockwise direction in FIG. 3 from the rotary shaft 69*x*. The raking belt 69 makes the front end of a sheet carried in along the uppermost sheet of the sheets stacked on the processing tray 54 abut against the sheet end regulating unit 61 while pressing the carried-in sheet.

The raking belt 69 is configured to be elevated/lowered above the uppermost sheet of the sheets stacked on the processing tray 54 by a belt shift motor M5 (hereinafter, referred to as "knurling elevation motor") (description of the elevation mechanism is omitted). The raking belt 69 is lowered at the timing when the sheet front end enters between the belt surface and the uppermost sheet to be engaged with the sheet. Further, when conveying a sheet bundle from the processing tray 54 to the first stack tray 26 using a sheet bundle carry-out unit 70 to be described later, the knurling elevation motor M5 is controlled such that the raking belt 69 is separated from the uppermost sheet and waits thereabove.

[Sheet Aligning Mechanism]

The processing tray 54 is provided with a sheet aligning mechanism that positions a carried-in sheet to a predetermined position (processing position). The illustrated sheet aligning mechanism includes the "sheet end regulating unit 61" for regulating the position of the end face (front end face or rear end face) in the sheet conveyance direction of a sheet carried out from the sheet discharge port 53 and the "sheet aligning unit 62" for aligning (width-aligning) a sheet in a direction (sheet side direction) perpendicular to the sheet conveyance direction. Hereinafter, the sheet end regulating unit 61 and the sheet aligning unit 62 will be described in this order.

The illustrated sheet end regulating unit 61 is constituted by a rear end regulating member 71 for abutment-regulating the rear end of a sheet in the sheet discharge direction. The rear end regulating member 71 has a regulating face 71*a* for abutment-regulating the rear end edge of a sheet in the sheet discharge direction carried in along the sheet placing surface 54*a* on the processing tray 54. The rear end of the sheet in the sheet discharge direction conveyed by the above raking conveyance unit 63 abuts against the regulating face 71*a* and is stopped.

The rear end regulating member 71 is configured so as not to interfere with movement of a stapler unit (movement in a direction perpendicular to the sheet discharge direction) when multi-binding is performed using the staple binding unit 56 to be described later. The following mechanisms can be taken as examples: (1) a mechanism in which the rear end regulating member 71 is made to advance to and retreat from the movement path (movement locus) of the staple binding unit 56; (2) a mechanism in which the rear end regulating member 71 is moved integrally with the staple binding unit 56; and (3) a mechanism in which the rear end regulating member 71 is constituted by a channel-shaped bent piece and is disposed inside a binding space constituted by a head and an anvil of the staple binding unit 56.

In the illustrated example, the mechanism of (3) is adopted. That is, the rear end regulating member 71 is constituted by a plate-like bent member having a U-shape (channel shape) in cross section and disposed in the binding space of the staple binding unit 56. With the minimum size sheet as a reference, a first rear end regulating member 71A is disposed at the sheet center, and second and third rear end regulating members 71B and 71C are disposed on both sides of the first rear end regulating member 71A so as to be spaced apart therefrom (see FIG. 5). This allows the staple binding unit 56 to be moved in a direction perpendicular to the sheet discharge direction of the stable binding unit 56.

The processing tray 54 is provided with the sheet aligning unit 62 for positioning a sheet abutting against the above rear end regulating member 71 in a direction (hereinafter, referred to as "sheet width direction") perpendicular to the sheet discharge direction. The sheet aligning unit 62 differs in its configuration depending on whether sheets of different sizes laid on the processing tray 54 are aligned with reference to the sheet center or its one side.

In the example of FIG. 5, sheets of different sizes are discharged from the sheet discharge port 53 with reference to the center, and the sheets are aligned on the processing tray 54 with reference to the center. Then, the sheets aligned in a bundle with reference to the center are subjected to binding. In the case of multi-binding in which binding is applied to a plurality of portions of the sheet bundle, the sheet bundle is set at the position aligned with reference to the center, and binding is applied to binding positions Ma1 and Ma2 by the staple binding unit 56. In the case of corner binding in which binding is applied around the corners in the sheet width direction, the sheet bundle is offset to one side in the sheet width direction by a predetermined distance, and binding is applied to binding positions Cp1 and Cp1 by the staple binding unit 56.

To perform the above aligning operation, the sheet aligning unit 62 is provided with a pair of side aligning members 72 (72F, 72R) each protruding upward from the sheet placing surface 54*a* of the processing tray 54 and each having a regulating surface 72*x* engaged with the side edge of a sheet in the sheet width direction. The side aligning members 72F and 72R are disposed opposite to each other in the sheet width direction and configured to reciprocate on the processing tray 54 in a predetermined stroke. The stroke amount is set based on the difference in size between a maximum size sheet and a minimum size sheet to be processed by the sheet post-processing unit B and the amount of offset movement of the aligned sheet bundle to one side in the sheet width direction. That is, the stroke amount of each of the side aligning members 72F and 72R is set based on the movement amount for aligning sheets of different sizes and movement amount for offsetting an aligned sheet bundle.

Figure 6:
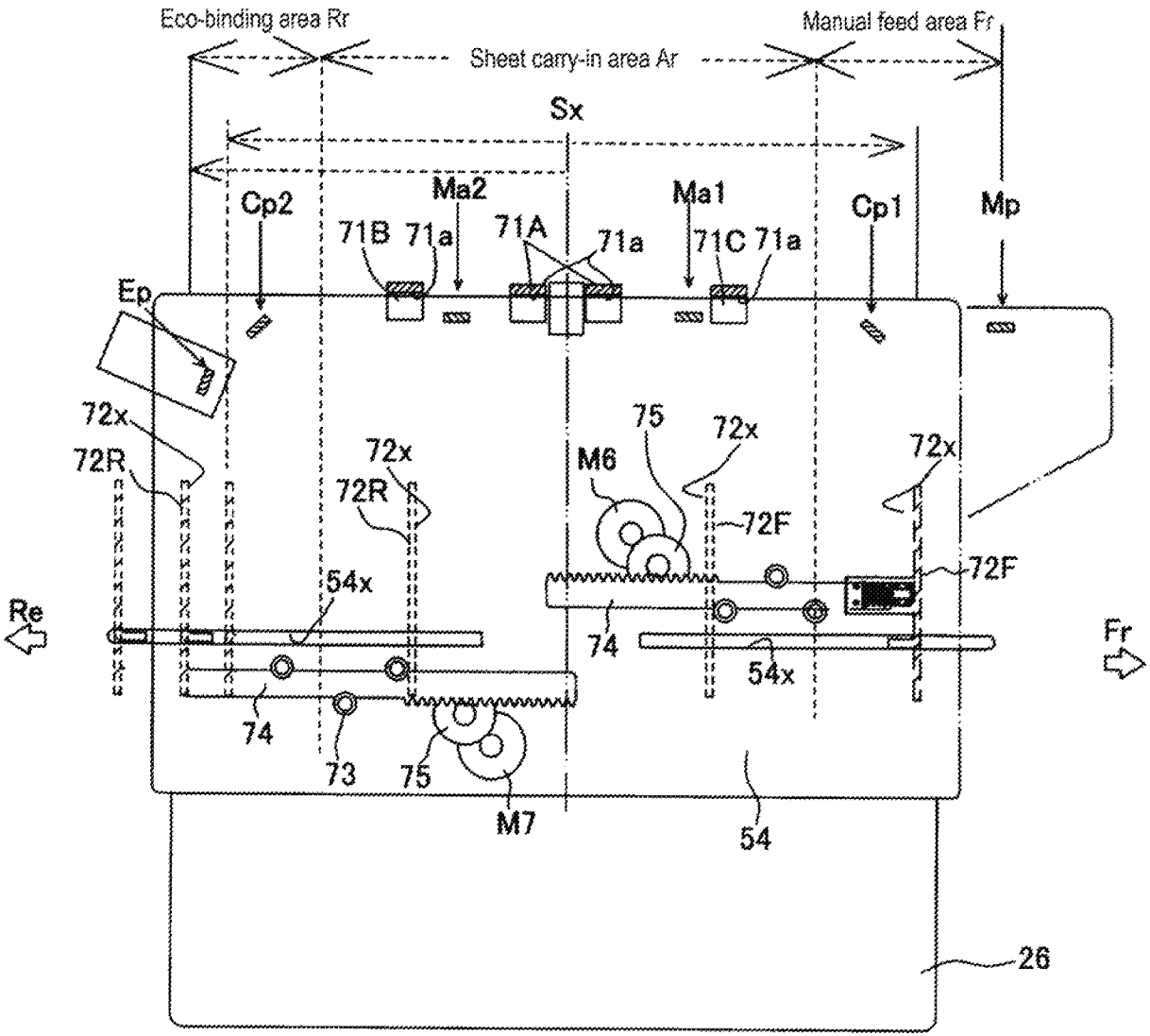
FIG. 6 is an explanatory view of the configuration of a side aligning member in the device of FIG. 2.

Thus, as illustrated in FIG. 6, the side aligning member 72 is constituted of the front-side side aligning member 72F and rear-side side aligning member 72R, and the side aligning members 72F and 72R are fitted to and supported by the processing tray 54 such that the regulating surfaces 72*x* thereof that are each engaged with the side edge of a sheet in the sheet width direction approach or separate from each other. A slit groove 54*x* is formed so as to penetrate the processing tray 54, and the side aligning member 72 having the regulating surface 72*x* engaged with the sheet side edge in the sheet width direction on the upper surface of the processing tray 54 is slidably fitted in the slit groove.

The side aligning members 72F and 72R are each integrally formed with a rack 74. The rack 74 is slidably supported by a plurality of guide rollers 73 (a rail member may be adopted in place of the guide rollers 73) on the back surface of the processing tray 54. The front-side and rear-side racks 74 are each connected with an aligning motor (M6, M7) through a pinion 75. The two aligning motors M6 and M7 are each constituted by a stepping motor. A not-shown position detection sensor is used to detect the positions of the respective two side aligning members 72F and 72R, and based on the detection value, the aligning motor can move each side aligning member in both the front and rear directions by a designated movement amount.

In place of the illustrated rack-and-pinion mechanism, a configuration may be adopted, in which the side aligning members 72F and 72R are each fixed to a belt, and the belt is connected, through a pulley, to a motor for reciprocating the belt in the front and rear directions.

With this configuration, the not-shown controller makes the two side aligning members 72 wait at a predetermined waiting position (sheet width+a) based on sheet size information provided from the image forming unit A. In this state, a sheet is carried in on the processing tray 54, and at the timing when the sheet rear end in the sheet discharge direction abuts against the rear end regulating member 71, aligning operation is started. In this aligning operation, the two aligning motors M6 and M7 are rotated in a direction in which the two side aligning members 72 approach each other by mutually the same amount. Then, sheets carried in on the processing tray 54 are positioned with reference to the sheet center and stacked in a bundle. By repetition of the sheet carry-in operation and aligning operation, the sheets are aligned and accumulated in a bundle on the processing tray 54.

The sheets so aligned and accumulated on the processing tray 54 with reference to the center can be subjected to so-called multi-binding in which the rear end or front end of the sheet bundle is bound at a plurality of portions spaced apart from each other at a predetermined distance in an aligned posture. Further, in the case of so-called corner binding in which binding is applied around the corners, one of the two side aligning members 72 is moved to a position corresponding to the side edge of the sheet in the sheet width direction. Then, the other one of the two side aligning members 72 is moved in a direction approaching the side aligning member 72 previously moved. The movement amount in the approaching direction is calculated based on the sheet size. Thus, when a sheet carried in on the processing tray 54 is subjected to corner binding at the sheet front side, aligning operation is performed such that the sheet front side edge in the sheet width direction coincides with the binding position, and when the sheet is subjected to corner binding at the sheet rear side, aligning operation is performed such that the sheet rear side edge in the sheet width direction coincides with the binding position.

[Sheet Binding Unit]

As described above, the sheets carried in from the sheet discharge port 53 of the sheet carry-in path 52 are aligned and accumulated on the processing tray 54, and the resultant aligned sheet bundle is then aligned to a predetermined position and in a predetermined posture by the sheet end regulating unit 61 and sheet aligning unit 62. Thereafter, the aligned sheet bundle is subjected to binding and carried out onto the first stack tray 26 positioned on the downstream side in the sheet discharge direction. Details of the binding processing will be described below.

The sheet binding unit 32 includes on the processing tray 54, as mechanisms for binding processing, the "staple binding unit 56 (hereinafter, referred to as "first binding unit") that binds a sheet bundle using a staple" and "stapleless binding unit 57 (hereinafter, referred to as "second binding unit") that applies crimping and deformation to a sheet bundle to bind it without a staple". Using a staple for binding allows bookbinding to make it difficult for the bound sheets to come off the bundle; however, such convenience that the bound sheets are easily separated from the sheet bundle may be required for some uses. Further, when a used sheet bundle is to be shredded, the metal staple needs to be removed before the shredding. Thus, it is preferable for a user to be able to select one from "staple binding" and "stapleless binding".

Further, in addition to a series of processing operations including the sheet carrying-in from the sheet carry-in path 52, alignment/accumulation, and binding, the sheet binding unit 32 can bind a sheet bundle formed outside the image forming apparatus of the present invention or a sheet bundle discharged in a condition where the binding processing therefor is not selected. To this end, a manual feed setting part 67 having a manual feed setting surface 67*a* on which the sheet bundle formed outside is set is formed in the outer casing 55*b*, and the above-mentioned first binding unit 56 is configured to be moved from a sheet carry-in area Ar of the processing tray 54 to a manual feed area Fr. As illustrated in FIG. 2, the manual feed setting surface 67*a* formed in the outer casing 55*b* is disposed at the corner of the image forming apparatus front side so as to extend from the inside to the outside of the apparatus.

As illustrated in FIG. 5, there are set "multi-binding positions Ma1, Ma2" for the sheet binding unit 32 to perform binding at a plurality of sites of the sheet using a staple, "corner binding positions Cp1, Cp1" for the sheet binding unit 32 to perform binding at the sheet corner, "manual binding position Mp" for the sheet binding unit 32 to perform binding of a sheet bundle set on the manual feed setting surface 67*a*, and "stapleless binding position Ep" for the sheet binding unit 32 to perform binding at the sheet corner without a staple being used. In the apparatus of the present invention, the multi-binding, corner binding, and manual binding are performed by the first binding unit, and the stapleless binding is performed by the second binding unit.

First, the "multi-binding" will be described. As illustrated in FIG. 5, in the multi-binding, binding is applied to the rear end in the sheet discharge direction of a sheet bundle (hereinafter, referred to as "aligned sheet bundle") aligned and positioned on the processing tray 54 by the sheet end regulating unit 61 and sheet aligning unit 62. In FIG. 5, there are set the two binding positions Ma1 and Ma2 spaced from each other at which the binding is performed. The first binding unit 56 is moved from a predetermined waiting position (home position) to the binding positions (Ma1 and Ma2 in this order) where binding is performed. The number of multi-binding positions is not limited to two, and may be three or more.

In the "corner binding", there are set the first corner binding position Cp1 at which the aligned sheet bundle on the processing tray 54 is bound at its corner on the apparatus front side and the second corner binding position Cp1 at which the aligned sheet bundle is bound at its corner on the apparatus rear side. When this corner binding is performed, the first binding unit is inclined with respect to the sheet end edge at a predetermined angle (about 30° to about 60°). Accordingly, the staple driven into the aligned sheet bundle is inclined at the predetermined angle with respect to the sheet end edge.

While configurations in which binding is selectively applied to one of the front and rear sides of the aligned sheet bundle and in which binding is performed with the staple inclined with respect to the sheet end edge have been described, the present invention is not limited to the above configurations, and a configuration in which binding is applied to only one of the front and rear sides of the aligned sheet bundle and a configuration in which binding is performed with the staple not inclined with respect to the sheet end edge but driven parallel to the end edge of the long side or short side of the aligned sheet bundle may be adopted.

The manual binding position Mp at which the "manual binding" is performed is set on the manual feed setting surface 67*a* formed in the outer casing 55*b*. The manual feed setting surface 67*a* is disposed adjacently in parallel to the sheet placing surface 54*a* through the side frame 55*c* at a height position substantially flush with the sheet placing surface 54*a* of the processing tray 54. In the illustrated example, both the sheet placing surface 54*a* of the processing tray 54 and the manual feed setting surface 67*a* support a sheet in a substantially horizontal posture and at substantially the same height.

That is, in FIG. 5, the manual feed setting surface 67*a* and the sheet placing surface 54*a* are disposed on the front side and rear side, respectively, with the side frame 55*c* as the boundary. The manual binding position Mp is set on the same line as the above-mentioned multi-binding position Ma arranged on the sheet placing surface 54*a*. This is for allowing both the multi-binding and manual binding to be performed by the same staple binding unit 56. Thus, there are set, on the processing tray 54, the sheet carry-in area Ar, manual feed area Fr (apparatus front side), and stapleless binding (eco-binding) area Rr (apparatus rear side).

The "stapleless binding" is performed at the stapleless binding position Ep (hereinafter, referred to as "eco-binding position") set on the apparatus rear side so as to apply binding around the sheet corner, as illustrated in FIG. 5. In the illustrated example, the eco-binding position Ep is set at a position allowing binding to be applied to the rear side corner at the rear end of the aligned sheet bundle in the sheet discharge direction. The stapleless binding is applied with a predetermined inclination angle with respect to the sheet end edge. The eco-binding position Ep is set in the eco-binding area Rr separated from the sheet carry-in area Ar on the processing tray 54 to the apparatus rear side.

As to the configurations of the staple binding unit 56 and stapleless binding unit 57 and control therefor, the mechanisms of the stapler unit and press-binder unit are disclosed in JP 2015-16970 A. The staple binding unit 56 and stapleless binding unit 57 according to the present invention respectively adopt configurations and controls that are similar to those of their counterparts described in JP 2015-16970 A, so detailed description thereof is omitted.

[Sheet Bundle Carry-Out Unit]

Figure 7A:
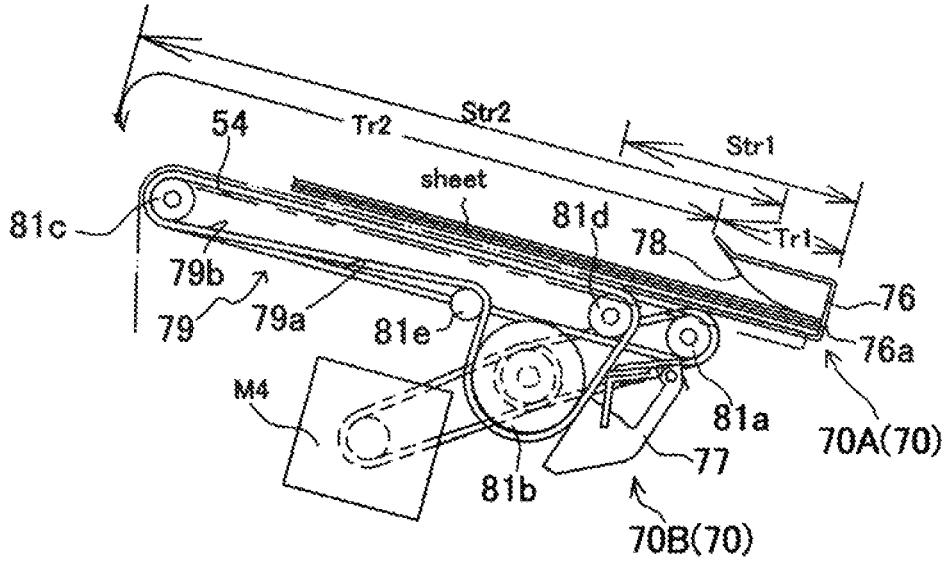

The sheet bundle carry-out unit 70 illustrated in FIGS. 7A to 7C will be described. The above-mentioned processing tray 54 is provided with the sheet bundle carry-out unit for carrying out a sheet bundle bound by the first binding unit 56 or second binding unit 57 onto the first stack tray 26 disposed on the downstream side in the sheet discharge direction. On the processing tray 54 described using FIG. 5, the first rear end regulating member 71A is disposed at the sheet center Sx, and the second and third rear end regulating members 71B and 71C are disposed on both sides in the sheet width direction of the first rear end regulating member 71A spaced apart therefrom. A sheet bundle stopped by the rear end regulating member 71 is bound by the first binding unit 56 or second binding unit 57 and is then carried out onto the first stack tray 26 disposed on the downstream side in the sheet discharge direction.

The sheet bundle carry-out unit 70 is disposed along the sheet placing surface 54*a* of the processing tray 54. The illustrated sheet bundle carry-out unit 70 includes a first bundle conveyance member 70A and a second bundle conveyance member 70B. Conveyance of a sheet bundle on the processing tray 54 is relayed from the first bundle conveyance member 70A to the second bundle conveyance member 70B. That is, the sheet bundle is first conveyed by the first bundle conveyance member 70A in a first section Tr1 and then by the second bundle conveyance member 70B in a second section Tr2. With this configuration, the first bundle conveyance member 70A and second bundle conveyance member 70B can provide different structures. The first bundle conveyance member 70A that conveys a sheet bundle from a position substantially corresponding to the sheet end regulating unit 61 needs to be constituted by a member (long support member) having a firm structure, and the second bundle conveyance member 70B that drops the sheet bundle onto the first stack tray 26 at a conveyance end point needs to have a small size so as to be moved along a loop-like locus.

The first bundle conveyance member 70A is constituted by a first conveyance member 76 formed by a bent piece having a channel shape in cross section and has a stop surface 76*a* for stopping the rear end edge of a sheet bundle in the sheet discharge direction and a sheet surface pressing member 78 which is made of an elastic film material or the like and configured to press the upper surface of the sheet bundle stopped by the stop surface 76*a*. The first conveyance member 76 is formed by the channel-shaped bent piece as illustrated, so that when being fixed to the carrier member 79 (to be described later) constituted by a belt, it travels integrally with the belt to push the rear end of the sheet bundle to deliver the sheet bundle in the sheet discharge direction without swinging. The first conveyance member 76 reciprocates in a section Str1 illustrated in FIG. 7A along a substantially linear locus without traveling in a curved looped locus to be described later.

The second bundle conveyance member 70B is constituted by a second conveyance member 77 having a claw shape and has a stop surface 77*a* for stopping the rear end edge of a sheet bundle in the sheet discharge direction and a sheet surface pressing member 80 for pressing the upper surface of the sheet bundle. The sheet surface pressing member 80 is axially swingably supported by the second conveyance member 77 and has a sheet surface pressing surface 80*a*. The sheet surface pressing surface is biased by a biasing spring 80*b* so as to press the upper surface of the sheet bundle.

The sheet surface pressing surface 80*a* is constituted by an inclined surface inclined with respect to the traveling direction of the second conveyance member 77 as illustrated. Accordingly, when the second conveyance member 77 is moved in a direction of the arrow in FIG. 7B, the sheet surface pressing surface 80*a* is engaged with the sheet rear end at a nipping angle γ. At this time, the sheet surface pressing surface 80*a* is deformed in the counterclockwise direction in the drawing against the biasing force of the biasing spring 80*b*. Then, as illustrated in FIG. 7C, the sheet surface pressing surface 80*a* presses the upper surface of the sheet bundle toward the sheet placing surface 54*a* by the action of the biasing spring 80*b*.

Like the first conveyance member 76, the second conveyance member 77 is fixed to the carrier member 79 constituted by the belt and travels integrally with the belt to push the rear end of the sheet bundle to deliver the sheet bundle in the sheet discharge direction. The first conveyance member 76 and the second conveyance member 77 reciprocate from the base portion of the sheet placing surface 54*a* to the end portion (hereinafter, referred to as "exit end portion") of the processing tray 54 on the downstream side in the sheet discharge direction by a first carrier member 79*a* and a second carrier member 79*b*, respectively. To this end, the sheet placing surface 54*a* is provided with drive pulleys 81*a*, 81*b* and a driven pulley 81*c* which are spaced apart from each other by a conveyance stroke. Reference numerals 81*d* and 81*e* are each an idle pulley.

The first carrier member 79*a* (toothed belt in the illustrated example) is stretched between the drive pulley 81*a* and the driven pulley 81*c*, and the second carrier member 79*b* (toothed belt) is stretched between the drive pulley 81*b* and the driven pulley 81*c* through the idle pulleys 81*d* and 81*e*. The drive pulleys 81*a* and 81*b* are connected with a drive motor M4. The drive pulley 81*a* has a small diameter and the drive pulley 81*b* has a large diameter so that a lower drive speed is transmitted from the motor M4 to the first carrier member 79*a* and a higher drive speed is transmitted from the motor M4 to the second carrier member 79*b*.

That is, the first bundle conveyance member 70A and the second bundle conveyance member 70B are connected to the common drive motor M4 through a decelerating mechanism such as a belt, a pulley, or a gear such that the first bundle conveyance member 70A travels at a lower speed and that the second bundle conveyance member 70B travels at a higher speed. Further, the drive pulley 81*b* incorporates therein a cam mechanism for delaying transmission of the drive. This is because a stroke range Str1 of the first bundle conveyance member 70A and a stroke range Str2 of the second bundle conveyance member 70B differ from each other as will be described later and because the waiting positions of the first bundle conveyance member 70A and second bundle conveyance member 70B need to be adjusted.

With the configuration described above, the first bundle conveyance member 70A reciprocates in the stroke range Str1 from a position at which the rear end regulating member 71 of the processing tray 54 is disposed along a linear locus. The first section Tr1 within which a sheet bundle is conveyed only by the first bundle conveyance member 70A is set in the stroke range Str1. The second bundle conveyance member 70B reciprocates in the stroke range Str2 from the middle of the first section Tr1 to the exit end portion of the processing tray 54 along a half loop-like locus. The second section Tr2 within which a sheet bundle is conveyed only by the second bundle conveyance member 70B is set in the stroke range Str2.

The first bundle conveyance member 70A is moved in the sheet discharge direction from the position of the rear end regulating member 71 at a speed V1 by the rotation of the drive motor M4 in one direction and conveys a sheet bundle while pushing the rear end of a sheet bundle in the sheet discharge direction with its stop surface 76*a*. Then, after the elapse of a predetermined time period from the start of the movement of the first bundle conveyance member 70A, the second bundle conveyance member 70B moves up onto the sheet placing surface 54*a* from a waiting position on the back side of the processing tray 54 and moves in the sheet discharge direction at a speed V2 following the first bundle conveyance member 70A. At this time, the above-mentioned deceleration mechanism is set such that speed V1 is lower than the speed V2 (V1<V2), so that conveyance of the sheet bundle on the processing tray 54 is relayed from the first bundle conveyance member 70A to the second bundle conveyance member 70B in the middle of the first section Tr1.

Figure 7B:
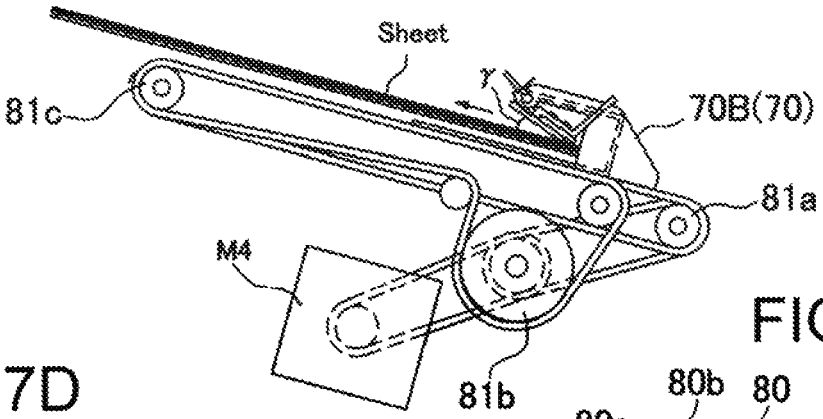
Figure 7C:
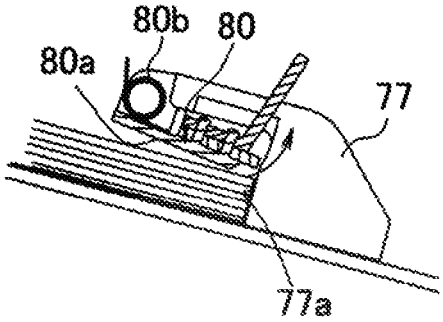
Figure 7D:
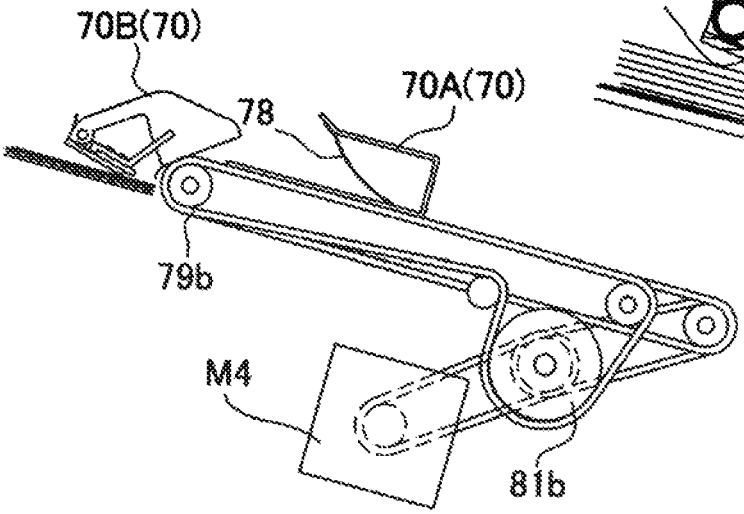

FIG. 7B illustrates a state where the conveyance is relayed. A sheet bundle conveyed at the speed V1 is caught up by the second bundle conveyance member 70B moving at the speed V2. That is, after passing through the first section Tr1, the first bundle conveyance member 70A is caught up by the second bundle conveyance member 70B, and the second bundle conveyance member 70B is engaged with the rear end of the sheet bundle in the sheet discharge direction to thereby convey the sheet bundle in the second section Tr2. Then, the second bundle conveyance member 70B carries out the sheet bundle toward the first stack tray 26 while holding the rear end of the sheet bundle.

[First Stack Tray]

Figure 8:
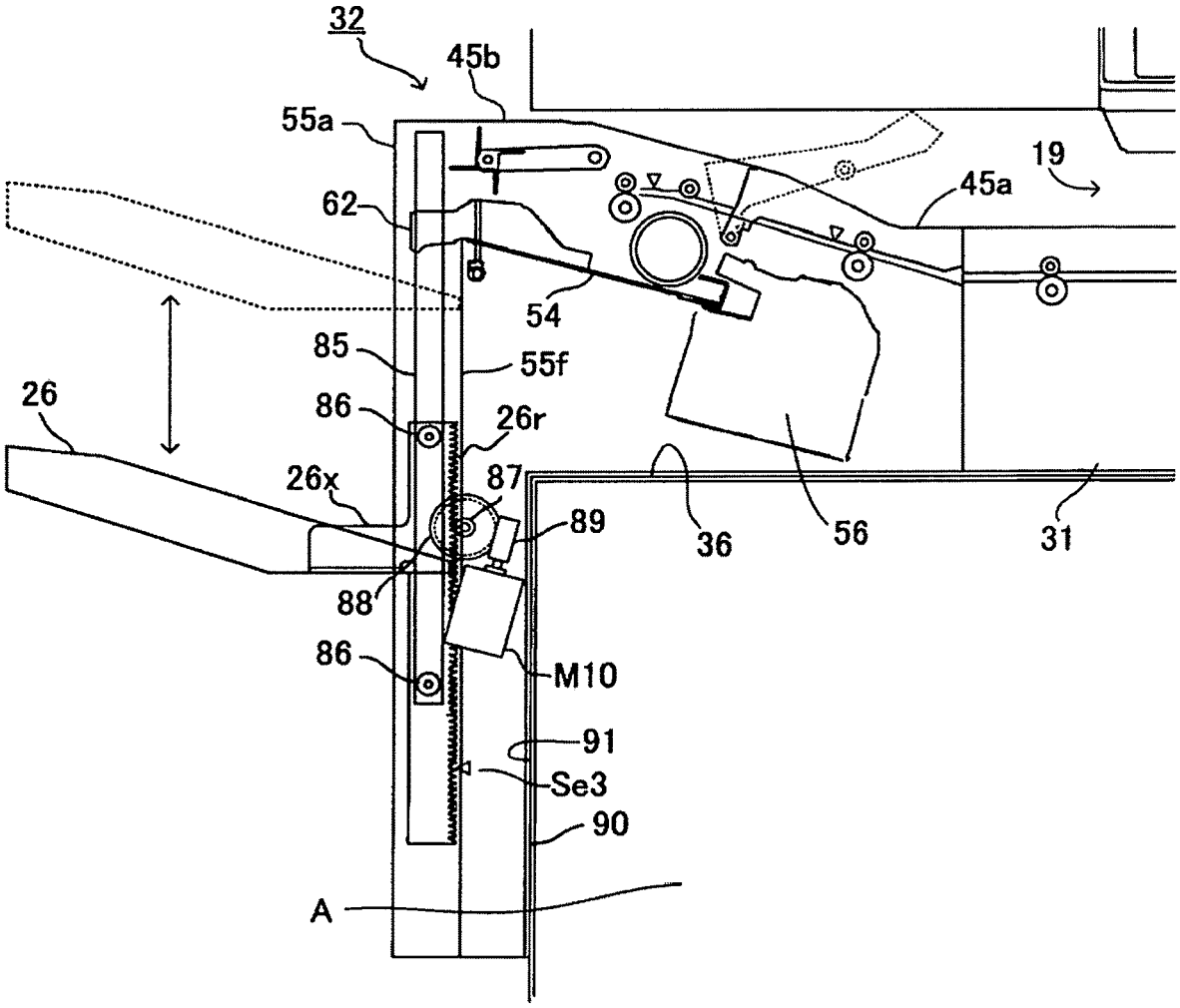
FIG. 8 is an explanatory view of the configuration of the first stack tray in the device of FIG. 2.

The configuration of the first stack tray 26 will be described based on FIG. 8. The first stack tray 26 is disposed on the downstream side of the processing tray 54 in the sheet discharge direction and stacks thereon the sheet bundle processed on the processing tray 54 for storage. The first stack tray 26 is provided with a mechanism for elevating/lowering the tray 26 such that the tray 26 is lowered in accordance with the stacking amount of sheets, i.e., the weight of the sheet bundle thereon. The stacking surface (surface of the uppermost sheet) of the first stack tray 26 can be elevated to a height position substantially flush with the sheet placing surface 54*a* of the processing tray 54.

The mechanism for elevating/lowering the first stack tray 26 will be described concretely below. The unit frame 55*a* is fixed with an elevation rail 85 extending in the stacking direction (vertical direction) of the sheet bundle. The end portion of the first stack tray 26 on the upstream side in the sheet discharge direction is fixed to a tray base 26*x*. The tray base 26*x* is fixed with two slide rollers 86 which are rotatably axially supported at positions vertically sandwiching the fixed position of the first stack tray 26. The outer periphery of each of the slide rollers 86 and the elevation rail 85 are slidably fitted to each other.

Further, a rack 26*r* is integrally formed with the tray base 26*x* so as to extend in parallel to the tray base 26*x*. The rack 26*r* is engaged with a gear tooth formed in a drive pinion 87 axially supported by the unit frame 55*a*. Further, a worm wheel 88 is integrally formed with the drive pinion 87 so as to surround the outer periphery of the drive pinion 87. The worm wheel 88 is connected to an elevation motor M10 through a worm gear 89. The elevation motor M10 is also fixed to the unit frame 55*a*.

Thus, when the elevation motor M10 is rotated normally and reversely, the rack 26*r* connected to the drive pinion 87 is moved upward and downward with respect to the unit frame 55*a*. In this mechanism, the tray base 26*x* is elevated/lowered while supporting the end portion of the first stack tray 26 on the upper stream side in the sheet discharge direction in a cantilever manner. Although a mechanism using the rack and pinion is used as the mechanism for elevating/lowering the tray in the example of FIG. 8, another mechanism that elevates/lowers the tray using a belt and pulley system can be adopted, in which a belt is wound on a pulley and the pulley is driven by a motor connected thereto.

The stacking surface of the first stack tray 26 integrally mounted to the tray base 26*x* is inclined at a predetermined angle (e.g., 20° to 60°) such that the upstream side in the sheet discharge direction is lowered so as to allow the sheet bundle to abut against a tray aligning surface 55*f* at its rear end in the sheet discharge direction by its own weight.

The elevation rail 85 that guides the movement of the tray base 26*x* extends in the elevating/lowering direction of the first stack tray 26 straddling an in-body installation surface 36 on which a part of the sheet binding unit 32 inside the sheet discharge space 19 is installed. This allows the first stack tray 26 to be lowered below the in-body installation surface 36, making it possible for sheets to be stacked in a wider vertical range than the sheet discharge space 19.

A drive part for elevating/lowering the tray, which is constituted of the drive pinion 87 integrally having the worm wheel 88 and the elevation motor M10 having the worm gear 89, is disposed below the in-body installation surface 36 on which a part of the sheet binding unit 32 inside the sheet discharge space 19 is installed. Further, the drive part is disposed on the side surface of the outer casing of the image forming unit A at a portion to which the unit frame 55*a* extends in the elevating/lowering direction of the stack tray 26.

As a result, as compared to a case where the drive part is disposed above the in-body installation surface 36, a range in which the first stack tray 26 is elevated/lowered by a combination of one elevation motor M10 and rack 26*r* can be easily extended. Further, the lower limit position is set for the first stack tray 26 so as not to allow abnormal lowering of the tray, and a limit sensor Se3 for detecting the tray is disposed at the lower limit position.

In the drive part for elevating/lowering the first stack tray 26, the first stack tray 26 positioned on the most downstream side in the sheet discharge direction, the tray base 26*x* fixing the first stack tray 26, and the rack 26*r* formed at a part of the tray base 26*x* opposite to the first stack tray 26 are arranged in this order from the downstream side in the sheet discharge direction. Accordingly, the drive part is disposed below a part of a second binding unit cover 45*b* that extends outside the unit body and between the rack 26*r* formed in the tray base 26*x* and the outer casing 55*b* extending along the side surface of the image forming unit A.

The elevation motor M10 is disposed between the rack 26*r* and the outer casing 55*b* extending along the side surface of the image forming unit A with the rotary axis thereof inclined at a predetermined angle with respect to the extending direction of the side surface 90 of the image forming unit A and is fixed to the unit frame 55*a*. As a result, as compared to a case where the rotary axis of the motor M10 is disposed parallel to the extending direction of the side surface 90 of the image forming unit A, the elevation motor M10 can be disposed in a reduced space.

By obliquely disposing the elevation motor M10, the worm gear 89 fixed to the motor shaft and rotated together therewith approaches the outer casing 55*b*. When the sheet binding unit 32 is mounted to the image forming unit A using a surface on which a sheet is delivered from the relay conveyance unit 31 to the sheet binding unit 32 as a reference, a part of the outer casing 55*b* extending in the elevating/lowering direction of the first stack tray 26 is bent, which may cause the outer casing 55*b* and worm gear 89 to interfere with each other.

Thus, an extension surface 91 of the outer casing 55*b* extending in the elevating/lowering direction of the first stack tray 26 that contacts the side surface 90 of the image forming unit A is used as a regulating surface for positioning at installation. As a result, the fixing position of the sheet binding unit 32 to the image forming unit A is regulated by the extension surface 91 of the outer casing positioned close to the drive part, preventing interference between the outer casing 55*b* and the worm gear 89.

[Operation Part]

Figure 9:
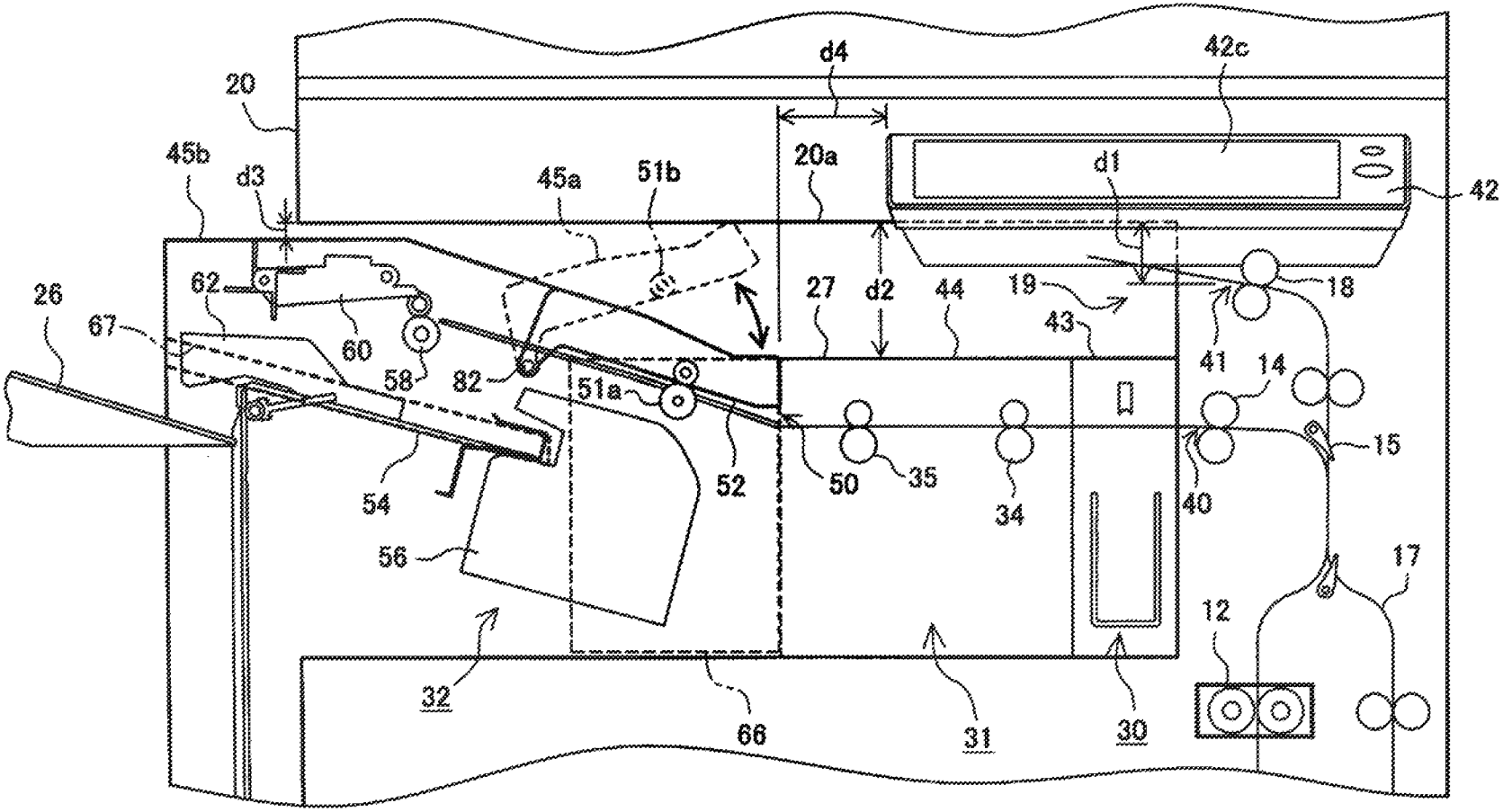
FIG. 9 is an explanatory view of the configuration of a second stack tray in the sheet post-processing unit of FIG. 1.

The operation part 42 illustrated in FIG. 9 includes an operation input part 42*a* that receives an input with respect to the image reading unit C, image forming unit A, and sheet post-processing unit B and an operation display part 42*b* that displays and outputs various information items. In the image forming apparatus according to the present invention, a substantially plate-like operation panel part 42*c* is provided. The operation panel part 42*c* has, at its front side, a touch panel. The touch panel is constituted by embedding, e.g., a piezoelectric sensor in a liquid crystal panel and is configured to display various information items and receive an operation input from an operator. For example, the touch panel displays a menu screen. The operator can set various operation contents of the image forming apparatus by touching a button (button-shaped image) virtually arranged in the touch panel. The touch panel functions both as a part of the operation input part 42*a* and a part of the operation display part 42*b*.

The operation part 42 is provided in a casing formed integrally with the outer casing of the image reading device 20 or fixed to the outer casing of the image reading device 20 through a turnable mounting tool such as a hinge. In either of the described configurations, the operation part 42 protrudes from the front side of the image reading device 20 to be disposed at a position overlapping the first discharge port 40 and second discharge port 41 on the side at which the document stacker 25 of the image reading unit C is disposed.

[Second Stack Tray]

A second stack tray 27 provided above the sheet post-processing unit B will be described using FIG. 9. The second stack tray 27 is constituted by continuous arrangement of a punch unit cover 43, a relay unit cover 44, and binding unit cover 45 which are outer casings provided at the topmost positions of the respective punch unit 30, relay conveyance unit 31, and sheet binding unit 32 which are disposed in the sheet discharge space 19.

The punch unit cover 43 and relay unit cover 44 are each formed into a flat surface horizontally extending in the sheet discharge direction. Accordingly, the distance between the punch unit cover 43, relay unit cover 44 and a bottom surface 20*a* of the image reading device 20 disposed above the punch unit cover 43 and relay unit cover 44 is kept substantially constant.

The binding unit cover 45 keeps a horizontal shape continuing from the relay unit cover 44 around the carry-in port 50 adjacent to the relay unit cover 44, then inclined upward from a portion on the upstream side of the carry-in roller pair 51 in the sheet discharge direction, and then becomes a horizontally-extending flat surface once again at a portion on the downstream side of the discharge roller pair 58 in the sheet discharge direction. The flat surface extends from the inside of the body to the outside thereof from the sheet discharge space 19 positioned inside the body of the image forming apparatus toward a portion above the first stack tray 26 positioned outside the body of the image forming apparatus 20.

The second discharge port 41 at which a sheet is discharged from the second main body discharge roller 18 of the image forming unit A is disposed spaced apart from the bottom surface 20*a* of the image reading device 20 at a distance d1. The upper surfaces of the respective punch unit cover 43 and relay unit cover 44 are spaced apart from the bottom surface 20*a* of the image reading device 20 at a distance d2. The distances d1 and d2 are set so as to satisfy d1<d2. Thus, a level difference is formed between the second discharge port 41 and the upper surfaces of the respective punch unit cover 43 and relay unit cover 44, allowing stacking of a sheet carried out from the second discharge port 41.

The binding unit cover 45 is constituted of a first binding unit cover 45*a* (openable cover) having one end as the carry-in port 50 and a second binding unit cover 45*b* having a portion extending above the first stack tray 26 positioned outside the body (i.e., outside the sheet discharge space 19). The first binding unit cover 45*a* is turnably mounted with a cover shaft 82 fixed to the unit frame 55*a* as a fulcrum so as to open the carry-in port 50 side of the sheet carry-in path 52. That is, the turning area of the first binding unit cover 45*a* serves also as the sheet stacking space of the second stack tray.

The carry-in roller pair 51 is constituted of a drive-side carry-in roller 51*a* (drive roller) and a driven-side carry-in roller 51*b* (driven roller) driven so as to follow the carry-in roller 51*a*. The carry-in roller 51*b* is rotatably axially supported by the first binding unit cover 45*a* and is biased by a not-shown elastic member toward the carry-in roller 51*a*. When the first binding unit cover 45*a* is opened upward, the carry-in roller 51*b* supported by the cover 45*a* is moved upward together with the first binding unit cover 45*a*, so that nip of the carry-in roller pair 51 is released.

When abnormal stop of conveyance (hereinafter, referred to as "JAM") occurs due to some cause after the release of the nip of the carry-in roller pair 51 between the second relay conveyance roller pair 35 of the relay conveyance unit 31 and the carry-in roller pair 51 of the sheet binding unit 32, it is possible to easily access the JAM sheet, allowing the operator to remove the sheet jammed in the sheet carry-in path 52.

Further, also when the JAM occurs between the carry-in roller pair 51 and the discharge roller pair 58 of the sheet binding unit 32, it is possible to easily access and remove the JAM sheet. The end portion of the first binding unit cover 45*a* on the carry-in port 50 side is positioned on the downstream side so as to be spaced apart at a predetermined distance from the end portion of the operation part 42 on the downstream side in the sheet discharge direction. Specifically, in FIG. 9, a distance d4 from one end portion of the operation part 42 to the carry-in port 50 is set to about 50 mm to about 70 mm. This allows easy access to the opening of the first binding unit cover 45*a*.

Further, the cover shaft 82 serving as the turning fulcrum of the first binding unit cover 45*a* is located at a position higher than the one end of the first binding unit cover 45*a* on the carry-in port 50 side. This level difference allows the one end of the first binding unit cover 45*a* on the carry-in port 50 side to be opened wide with a small turning angle of the first binding unit cover 45*a*. This allows easy access to the JAM sheet in the sheet carry-in path 52.

The second binding unit cover 45*b* is constituted of a part inclined at the same angle as the inclination angle of the first binding unit cover 45*a* and a part having a flat surface extending substantially horizontally on the downstream side of the discharge roller pair 58 in the sheet discharge direction. The flat surface is located spaced apart from the bottom surface 20*a* of the image reading device 20 at a distance d3. That is, the second stack tray 27 has a surface on which a sheet can be stacked extending from the inside to the outside of the body of the apparatus in the sheet discharge direction, allowing a longer sheet to be stacked and retained on the tray. Further, when a long sheet extending beyond the end portion of the second binding unit cover 45*b* on the downstream side in the sheet discharge direction is carried out from the second discharge port 41, the front end of the sheet can be received by the first stack tray 26.

[Staple Exchange Cover]

As described above using FIG. 5, the sheet binding unit 32 has, as the mechanisms for binding processing, the first binding unit 56 that binds a sheet bundle using a staple and the second binding unit 57 that crimps and deforms a sheet bundle to bind it without a staple. The first binding unit 56 performs binding using a staple, so that there occurs a need to replenish staples after the staples are used up.

For the replenishment of the staples, the first binding unit 56 is moved to the manual binding position Mp by a not-shown drive unit and rotated by a predetermined angle toward a staple exchange cover 66. The staple exchange cover 66 is axially supported by a staple exchange cover shaft 66*x* and turnably fixed to the outer casing 55*b* with one end of the sheet binding unit 32 on the carry-in port 50 side (on the upstream side in the sheet discharge direction) as an opening.

As in the case of the first binding unit cover 45*a*, one end of the staple exchange cover 66 on the upstream side in the sheet discharge direction is positioned spaced apart to the downstream side from the end portion of the operation part 42 on the downstream side in the sheet discharge direction at a predetermined distance (distance d4). This prevents the operation part 42 from interfering with the replenishment of staples, ensuring easy access to the staple exchange cover 66 at the replenishment.

According to the above-described embodiment for practicing the present invention, the following advantages can be achieved.

An image forming apparatus includes a sheet processing device (sheet binding unit 32) including a sheet processing part provided inside a sheet discharge space between an image reading unit C and an image forming unit A and configured to apply binding to sheets and a first stacking part (first stack tray 26) disposed adjacent to the sheet processing part and outside the sheet discharge space and configured to stack thereon the sheets processed by the sheet processing part. The image forming apparatus further includes a first discharge port 40 for discharging a sheet on which an image is formed by the image forming unit A toward the sheet processing device, a second discharge port 41 for discharging the sheet on which the image is formed by the image forming unit A toward the sheet discharge space, and an operation part for inputting predetermined operational items to the image reading unit C, image forming unit A, and sheet processing device. The sheet processing device includes a carry-in port 50 for receiving a sheet from the first discharge port 40, a conveyance unit (carry-in roller 51) for conveying the sheet received from the carry-in port 50 toward a processing tray 54 in a predetermined conveyance direction, an openable cover (first binding unit cover) disposed above the conveyance unit and configured to open the carry-in port 50 for removal of a sheet when a sheet conveyance failure occurs in the conveyance unit, and a second stacking part (second stack tray 27) for stacking a sheet discharged from the second discharge port 41 on the upper surface of the openable cover. The carry-in port 50 is disposed on a downstream side in the conveyance direction so as to be spaced apart at a predetermined distance from the end portion of the operation part on the downstream side in the conveyance direction.

With this configuration, the operation part and the openable cover of the sheet processing device are arranged spaced part from each other at a predetermined distance, so that when a sheet conveyance failure occurs in the sheet conveyance path inside the sheet processing device, it is possible to remove the sheet stuck there by opening the openable cover without the need to separate the sheet processing device from the image forming apparatus.

The image forming apparatus further includes a relay conveyance unit 31 for relaying the conveyance of a sheet between the first discharge port 40 and the sheet processing device. A third stacking part (relay unit cover 44) for stacking thereon a sheet discharged from the second discharge port 41 is provided adjacent to the second stacking part, the third stacking part being disposed above the relay conveyance unit. A distance between the bottom side of the image reading unit C and the third stacking part is larger than a distance between the bottom side of the image reading unit C and the second discharge port. With this configuration, a level difference is formed between the second discharge port 41 and the second and third stacking parts, thus making it possible to ensure a space for sheet stacking in the sheet discharge space between the image reading unit C, and the relay conveyance unit 31 and sheet processing device.

In the image forming apparatus, the openable cover has a turning fulcrum for turning the openable cover to the downstream side relative to the carry-in port 50 in the sheet conveyance direction. The upper surface of the openable cover is inclined downward from the turning fulcrum toward the carry-in port 50. With this configuration, it is possible to open the carry-in port side of the openable cover with a small turning operation, allowing easy access to a sheet inside the sheet processing device.

In the image forming apparatus, the sheet processing device has a fourth stacking part extended in the sheet conveyance direction from the first stacking part so as to support a long sheet. The fourth stacking part is disposed so as to extend from the inside to the outside of the sheet discharge space 19. With this configuration, a stacking part is continuously formed from the inside to the outside of the body of the image forming unit, making it possible to support a longer sheet.

In the image forming apparatus, the first stacking part is movably disposed in the vertical direction. The sheet processing device includes a guide part for guiding the vertical movement of the first stacking part and a drive unit for moving the first stacking part along the guide part. The guide part is extended in the vertical direction so as to straddle an installation surface on which a part of the sheet processing device inside the sheet discharge space 19 is installed. With this configuration, the first stacking part can be moved beyond the vertical range of the sheet discharge space, allowing sheets to be stacked in a vertical range wider than the sheet discharge space.

In the image forming apparatus, the area of the fourth stacking part outside the sheet discharge space 19 overlaps an area where the drive unit is disposed. With this configuration, the fourth stacking part and drive unit can be arranged in a range where they partially overlap each other.

In the image forming apparatus, the sheet processing device includes a binding unit for binding sheets and an exchange cover that is opened/closed so as to allow replenishment of binding members used in the binding unit. The exchange cover is disposed on the downstream side in the sheet conveyance direction so as to be spaced apart at a predetermined distance from the end portion of the operation part on the downstream side in the conveyance direction. With this configuration, opening/closing operation of the exchange cover is not hindered at replenishment of staples used in the binding unit, ensuring good accessibility.

This application is based upon and claims the benefit of priority from prior Japanese Patent Application No. 2018-021828, the entire contents of which are incorporated herein by reference.

What is claimed is:

1. An image forming apparatus comprising:

an image reading part for reading an image;

an image forming part disposed below the image reading part with a space part provided below the image reading part interposed therebetween and configured to form an image on a sheet;

a sheet processing device including a sheet processing part provided inside the space part between the image reading part and the image forming part and configured to apply binding to sheets and a first stacking part disposed adjacent to the sheet processing part and outside the space part and configured to stack thereon the sheets processed by the sheet processing part;

a first discharge part for discharging the sheet on which an image is formed by the image forming part toward the sheet processing part;

a second discharge part for discharging the sheet on which an image is formed by the image forming part toward the space part; and an operation part for inputting predetermined operational items to the image reading part, image forming part, and sheet processing device, wherein the sheet processing device includes a carry-in part receiving a sheet from the first discharge part;

a conveyance unit for conveying the sheet received from the carry-in part toward the sheet processing part in a predetermined conveyance direction;

an openable cover disposed above the conveyance unit and configured to open the carry-in part for removal of a sheet when a sheet conveyance failure occurs in the conveyance unit; and a second stacking part for stacking a sheet discharged from the second discharge part on an upper surface of the openable cover; and the carry-in part is disposed on a downstream side in the conveyance direction so as to be spaced apart at a predetermined distance from an end portion of the operation part on the downstream side in the conveyance direction.

2. The image forming apparatus according to claim 1, further comprising a relay unit for relaying conveyance of a sheet between the first discharge part and the sheet processing device, wherein a third stacking part for stacking thereon a sheet discharged from the second discharge part is provided adjacent to the second stacking part, the third stacking part being disposed above the relay unit, and a distance between a bottom side of the image reading part and the third stacking part is larger than a distance between the bottom side of the image reading part and the second discharge part.

3. The image forming apparatus according to claim 1, wherein the openable cover has a turning fulcrum for turning the openable cover to the downstream side relative to the carry-in part in the conveyance direction, and an upper surface of the openable cover is inclined downward from the turning fulcrum toward the carry-in part.

4. The image forming apparatus according to claim 3, wherein the sheet processing device has a fourth stacking part extended in the conveyance direction from the second stacking part so as to support a long sheet, and the fourth stacking part is disposed so as to extend from an inside to an outside of the space part.

5. The image forming apparatus according to claim 4, wherein the first stacking part is movably disposed in the vertical direction, the sheet processing device includes a guide part for guiding the vertical movement of the first stacking part and a drive unit for moving the first stacking part along the guide part, and the guide part is extended in the vertical direction so as to straddle an installation surface on which a part of the sheet processing device inside the space part is installed.

6. The image forming apparatus according to claim 5, wherein an area of the fourth stacking part outside the space part overlaps an area where the drive unit is disposed.

7. The image forming apparatus according to claim 1, wherein the sheet processing device includes a binding unit for binding sheets; and an exchange cover that is opened/closed so as to allow replenishment of binding members used in the binding unit, and the exchange cover is disposed on the downstream side in the conveyance direction so as to be spaced apart at a predetermined distance from an end portion of the operation part on the downstream side in the conveyance direction.

* * * * *